US009777361B2

(12) United States Patent
Thomas et al.

(10) Patent No.: US 9,777,361 B2
(45) **Date of Patent: *Oct. 3, 2017**

(54) THERMOMECHANICAL PROCESSING OF ALPHA-BETA TITANIUM ALLOYS

(71) Applicant: ATI Properties, LLC, Albany, OR (US)

(72) Inventors: Jean-Phillippe A. Thomas, Charlotte, NC (US); Ramesh S. Minisandram, Charlotte, NC (US); Robin M. Forbes Jones, Charlotte, NC (US); John V. Mantione, Indian Trail, NC (US); David J. Bryan, Indian Trail, NC (US)

(73) Assignee: ATI PROPERTIES LLC, Albany, OR (US)

( * ) Notice: Subject to any disclaimer, the term of this patent is extended or adjusted under 35 U.S.C. 154(b) by 498 days.

This patent is subject to a terminal disclaimer.

(21) Appl. No.: 13/844,196

(22) Filed: Mar. 15, 2013

(65) Prior Publication Data

US 2014/0261922 A1 Sep. 18, 2014

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
CPC ..... C22F 1/183; C22F 1/10
(Continued)

(56) References Cited

U.S. PATENT DOCUMENTS 2,857,269 A 10/1958 Vordahl
2,893,864 A 7/1959 Harris et al.
(Continued)

FOREIGN PATENT DOCUMENTS

CN 1070230 A 3/1993
CN 1194671 A 9/1998
(Continued)

OTHER PUBLICATIONS

ATI 38-644™ Beta Titanium Alloy Technical Data Sheet, UNS R58640, Version 1, Dec. 21, 2011, 4 pages.
(Continued)

*Primary Examiner* — Jie Yang
(74) *Attorney, Agent, or Firm* — K&L Gates LLP

(57) ABSTRACT

One embodiment of a method of refining alpha-phase grain size in an alpha-beta titanium alloy comprises working an alpha-beta titanium alloy at a first working temperature within a first temperature range in the alpha-beta phase field of the alpha-beta titanium alloy. The alloy is slow cooled from the first working temperature. On completion of working at and slow cooling from the first working temperature, the alloy comprises a primary globularized alpha-phase particle microstructure. The alloy is worked at a second working temperature within a second temperature range in the alpha-beta phase field. The second working temperature is lower than the first working temperature. The is worked at a third working temperature in a third temperature range in the alpha-beta phase field. The third working temperature is lower than the second working temperature. After working at the third working temperature, the titanium alloy comprises a desired refined alpha-phase grain size.

20 Claims, 19 Drawing Sheets

(58) Field of Classification Search
USPC ..... 148/670
See application file for complete search history.

(56) References Cited

U.S. PATENT DOCUMENTS 2,932,886 A 4/1960 Althouse
2,974,076 A 3/1961 Vordahl
3,015,292 A 1/1962 Bridwell
3,025,905 A 3/1962 Haerr
3,060,564 A 10/1962 Corral
3,082,083 A 3/1963 Levy et al.
3,117,471 A 1/1964 O'Connell et al.
3,313,138 A 4/1967 Spring et al.
3,379,522 A 4/1968 Vordahl
3,436,277 A 4/1969 Bomberger, Jr. et al.
3,489,617 A 1/1970 Wuerfel
3,584,487 A 6/1971 Carlson
3,605,477 A 9/1971 Carlson
3,615,378 A 10/1971 Bomberger, Jr. et al.
3,635,068 A 1/1972 Watmough et al.
3,649,259 A 3/1972 Heitman
3,676,225 A 7/1972 Owczarski et al.
3,686,041 A 8/1972 Lee
3,802,877 A 4/1974 Parris et al.
3,815,395 A 6/1974 Sass
3,835,282 A 9/1974 Sass et al.
3,922,899 A 12/1975 Fremont et al.
3,979,815 A 9/1976 Nakanose et al.
4,053,330 A 10/1977 Henricks et al.
4,067,734 A * 1/1978 Curtis ..... C23G 1/106 148/407
4,094,708 A 6/1978 Hubbard et al.
4,098,623 A 7/1978 Ibaraki et al.
4,120,187 A 10/1978 Mullen
4,138,141 A 2/1979 Andersen
4,147,639 A 4/1979 Lee et al.
4,150,279 A 4/1979 Metcalfe et al.
4,163,380 A 8/1979 Masoner
4,197,643 A 4/1980 Burstone et al.
4,229,216 A 10/1980 Paton et al.
4,309,226 A 1/1982 Chen
4,472,207 A 9/1984 Kinoshita et al.
4,482,398 A 11/1984 Eylon et al.
4,510,788 A 4/1985 Ferguson et al.
4,543,132 A 9/1985 Berczik et al.
4,614,550 A 9/1986 Leonard et al.
4,631,092 A 12/1986 Ruckle et al.
4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,799,975 A 1/1989 Ouchi et al.
4,808,249 A 2/1989 Eylon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
4,889,170 A 12/1989 Mae et al.
4,919,728 A 4/1990 Kohl et al.
4,943,412 A 7/1990 Bania et al.
4,957,567 A 9/1990 Krueger et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,094,812 A 3/1992 Dulmaine et al.
5,141,566 A 8/1992 Kitayama et al.
5,156,807 A 10/1992 Nagata et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,256,369 A 10/1993 Ogawa et al.
5,264,055 A 11/1993 Champin et al.
5,277,718 A 1/1994 Paxson et al.
5,310,522 A 5/1994 Culling
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,374,323 A 12/1994 Kuhlman et al.
5,399,212 A 3/1995 Chakrabarti et al.
5,442,847 A 8/1995 Semiatin et al.
5,472,526 A 12/1995 Gigliotti, Jr.
5,494,636 A 2/1996 Dupoiron et al.
5,509,979 A 4/1996 Kimura
5,516,375 A 5/1996 Ogawa et al.
5,520,879 A 5/1996 Saito et al.
5,527,403 A 6/1996 Schirra et al.
5,545,262 A 8/1996 Hardee et al.
5,545,268 A 8/1996 Yashiki et al.
5,547,523 A 8/1996 Blankenship, Jr. et al.
5,558,728 A 9/1996 Kobayashi et al.
5,580,665 A 12/1996 Taguchi et al.
5,600,989 A 2/1997 Segal et al.
5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A 6/1998 Benz et al.
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,954,724 A 9/1999 Davidson
5,980,655 A 11/1999 Kosaka
6,002,118 A 12/1999 Kawano et al.
6,032,508 A 3/2000 Ashworth et al.
6,044,685 A 4/2000 Delgado et al.
6,053,993 A 4/2000 Reichman et al.
6,059,904 A 5/2000 Benz et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hajaligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,334,912 B1 1/2002 Ganin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.

(56) References Cited

U.S. PATENT DOCUMENTS 6,569,270 B2 5/2003 Segal
6,632,304 B2 10/2003 Oyama et al.
6,632,396 B1 10/2003 Tetjukhin et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.
6,786,985 B2 9/2004 Kosaka et al.
6,800,153 B2 10/2004 Ishii et al.
6,823,705 B2 11/2004 Fukuda et al.
6,908,517 B2 6/2005 Segal et al.
6,918,971 B2 7/2005 Fujii et al.
6,932,877 B2 8/2005 Raymond et al.
6,971,256 B2 12/2005 Okada et al.
7,008,491 B2 3/2006 Woodfield
7,010,950 B2 3/2006 Cai et al.
7,032,426 B2 4/2006 Durney et al.
7,037,389 B2 5/2006 Barbier et al.
7,038,426 B2 5/2006 Hall
7,096,596 B2 8/2006 Hernandez, Jr. et al.
7,132,021 B2 11/2006 Kuroda et al.
7,152,449 B2 12/2006 Durney et al.
7,264,682 B2 9/2007 Chandran
7,269,986 B2 9/2007 Pfaffmann et al.
7,332,043 B2 2/2008 Tetyukhin et al.
7,410,610 B2 8/2008 Woodfield et al.
7,438,849 B2 10/2008 Kuramoto et al.
7,449,075 B2 11/2008 Woodfield et al.
7,536,892 B2 5/2009 Amino et al.
7,559,221 B2 7/2009 Horita et al.
7,601,232 B2 * 10/2009 Fonte ..... C22F 1/183 148/670
7,611,592 B2 11/2009 Davis et al.
7,708,841 B2 5/2010 Saller et al.
7,837,812 B2 11/2010 Marquardt et al.
7,879,286 B2 2/2011 Miracle et al.
7,947,136 B2 5/2011 Saller
7,984,635 B2 7/2011 Callebaut et al.
8,037,730 B2 10/2011 Polen et al.
8,048,240 B2 11/2011 Hebda et al.
8,128,764 B2 3/2012 Miracle et al.
8,211,548 B2 7/2012 Chun et al.
8,316,687 B2 11/2012 Slattery
8,336,359 B2 12/2012 Werz
8,408,039 B2 4/2013 Cao et al.
8,454,765 B2 6/2013 Saller et al.
8,499,605 B2 8/2013 Bryan
8,568,540 B2 10/2013 Marquardt et al.
8,578,748 B2 11/2013 Huskamp et al.
8,608,913 B2 12/2013 Shim et al.
8,613,818 B2 * 12/2013 Forbes Jones ..... C22C 14/00 148/649
8,679,269 B2 3/2014 Goller et al.
8,919,168 B2 12/2014 Valiev et al.
9,034,247 B2 5/2015 Suzuki et al.
9,050,647 B2 * 6/2015 Thomas ..... B21J 1/025
9,192,981 B2 11/2015 Forbes Jones et al.
9,206,497 B2 * 12/2015 Bryan ..... C22F 1/183
2002/0033717 A1 3/2002 Matsuo
2003/0168138 A1 9/2003 Marquardt
2004/0099350 A1 5/2004 Manitone et al.
2004/0148997 A1 8/2004 Amino et al.
2004/0221929 A1 11/2004 Hebda et al.
2004/0250932 A1 12/2004 Briggs
2005/0047952 A1 3/2005 Coleman
2005/0145310 A1 7/2005 Bewlay et al.
2006/0045789 A1 3/2006 Nasserrafi et al.
2006/0110614 A1 5/2006 Liimatainen
2006/0243356 A1 11/2006 Oikawa et al.
2007/0017273 A1 1/2007 Haug et al.
2007/0193662 A1 8/2007 Jablokov et al.
2007/0286761 A1 12/2007 Miracle et al.
2008/0000554 A1 1/2008 Yaguchi et al.
2008/0103543 A1 5/2008 Li et al.
2008/0107559 A1 5/2008 Nishiyama et al.
2008/0202189 A1 8/2008 Otaki
2008/0210345 A1 9/2008 Tetyukhin et al.
2008/0264932 A1 10/2008 Hirota
2009/0000706 A1 1/2009 Huron et al.
2009/0183804 A1 7/2009 Zhao et al.
2009/0234385 A1 9/2009 Cichocki et al.
2010/0307647 A1 12/2010 Marquardt et al.
2011/0038751 A1 2/2011 Marquardt et al.
2011/0180188 A1 7/2011 Bryan
2012/0003118 A1 1/2012 Hebda et al.
2012/0012233 A1 1/2012 Bryan
2012/0060981 A1 3/2012 Forbes Jones et al.
2012/0067100 A1 3/2012 Stefansson et al.
2012/0076611 A1 3/2012 Bryan
2012/0076612 A1 3/2012 Bryan
2012/0076686 A1 3/2012 Bryan
2012/0177532 A1 7/2012 Hebda et al.
2012/0279351 A1 11/2012 Gu et al.
2012/0308428 A1 12/2012 Forbes Jones et al.
2013/0062003 A1 3/2013 Shulkin et al.
2013/0118653 A1 5/2013 Bryan et al.
2013/0156628 A1 6/2013 Forbes Jones et al.
2013/0291616 A1 11/2013 Bryan
2014/0060138 A1 3/2014 Hebda et al.
2014/0076468 A1 3/2014 Marquardt et al.
2014/0076471 A1 3/2014 Forbes Jones et al.
2014/0116582 A1 5/2014 Forbes Jones et al.
2014/0238552 A1 8/2014 Forbes Jones et al.
2015/0129093 A1 5/2015 Forbes Jones et al.
2016/0047024 A1 2/2016 Bryan
2016/0122851 A1 5/2016 Jones et al.
2016/0138149 A1 5/2016 Bryan
2017/0058387 A1 3/2017 Marquardt et al.

FOREIGN PATENT DOCUMENTS

CN 1403622 3/2003
CN 1816641 A 8/2006
CN 101104898 A 1/2008
CN 101205593 A 6/2008
CN 101294264 A 10/2008
CN 101684530 A 3/2010
CN 101637789 B 6/2011
CN 102212716 A 10/2011
CN 102816953 A 12/2012
DE 19743802 A1 3/1999
DE 10128199 A1 12/2002
DE 102010009185 A1 11/2011
EP 0066361 A2 12/1982
EP 0109350 A2 5/1984
EP 0320820 A1 6/1989
EP 0535817 B1 4/1995
EP 0611831 B1 1/1997
EP 0834580 A1 4/1998
EP 0870845 A1 10/1998
EP 0707085 B1 1/1999
EP 0683242 B1 5/1999
EP 0969109 A1 1/2000
EP 1083243 A2 3/2001
EP 1136582 A1 9/2001
EP 1302554 A1 4/2003
EP 1302555 A1 4/2003
EP 1471158 A1 10/2004
EP 1605073 A1 12/2005
EP 1612289 A2 1/2006
EP 1717330 A1 11/2006
EP 1882752 A2 1/2008
EP 2028435 A1 2/2009
EP 2281908 A1 2/2011
EP 1546429 B1 6/2012
FR 2545104 A1 11/1984
GB 847103 9/1960
GB 1170997 A 11/1969
GB 1433306 4/1976
GB 2151260 A 7/1985
GB 2337762 A 12/1999
JP 55-113865 A 9/1980
JP 57-62820 A 4/1982

(56) References Cited

FOREIGN PATENT DOCUMENTS

| | | | |
|---|---|---|---|
| JP | 57-62846 | A | 4/1982 |
| JP | 60-046358 | | 3/1985 |
| JP | 60-100655 | A | 6/1985 |
| JP | S61-217564 | A | 9/1986 |
| JP | 62-109956 | A | 5/1987 |
| JP | 62-127074 | A | 6/1987 |
| JP | 62-149859 | A | 7/1987 |
| JP | S63-49302 | A | 3/1988 |
| JP | S63-188426 | A | 8/1988 |
| JP | 1-279736 | A | 11/1989 |
| JP | 2-205661 | A | 8/1990 |
| JP | 3-134124 | A | 6/1991 |
| JP | H03-264618 | A | 11/1991 |
| JP | 4-74856 | A | 3/1992 |
| JP | 4-103737 | A | 4/1992 |
| JP | 4-168227 | A | 6/1992 |
| JP | 5-59510 | A | 3/1993 |
| JP | 5-117791 | A | 5/1993 |
| JP | 5-195175 | A | 8/1993 |
| JP | H05-293555 | A | 11/1993 |
| JP | 8-300044 | A | 11/1996 |
| JP | 9-143650 | | 6/1997 |
| JP | 9-194969 | A | 7/1997 |
| JP | 9-215786 | A | 8/1997 |
| JP | H10-128459 | A | 5/1998 |
| JP | H10-306335 | A | 11/1998 |
| JP | H11-21642 | A | 1/1999 |
| JP | H11-309521 | A | 11/1999 |
| JP | H11-319958 | A | 11/1999 |
| JP | 11-343528 | A | 12/1999 |
| JP | 11-343548 | A | 12/1999 |
| JP | 2000-153372 | A | 6/2000 |
| JP | 2000-234887 | A | 8/2000 |
| JP | 2001-71037 | A | 3/2001 |
| JP | 2001-081537 | A | 3/2001 |
| JP | 2001-343472 | A | 12/2001 |
| JP | 2002-146497 | A | 5/2002 |
| JP | 2003-55749 | A | 2/2003 |
| JP | 2003-74566 | A | 3/2003 |
| JP | 2003-285126 | A | 10/2003 |
| JP | 2003-334633 | A | 11/2003 |
| JP | 2007-291488 | A | 11/2007 |
| JP | 2007-327118 | A | 12/2007 |
| JP | 2008-200730 | A | 9/2008 |
| JP | 2009-138218 | A | 6/2009 |
| JP | 2009-299110 | A | 12/2009 |
| JP | 2009-299120 | A | 12/2009 |
| JP | 2010-70833 | A | 4/2010 |
| JP | 2012-140690 | A | 7/2012 |
| JP | 2015-54332 | A | 3/2015 |
| KR | 920004946 | | 6/1992 |
| KR | 10-2005-0087765 | A | 8/2005 |
| KR | 10-2009-0069647 | A | 7/2009 |
| RU | 1131234 | C | 10/1994 |
| RU | 2156828 | C1 | 9/2000 |
| RU | 2197555 | C1 | 7/2001 |
| RU | 2172359 | C1 | 8/2001 |
| RU | 2234998 | C1 | 8/2004 |
| RU | 2269584 | C1 | 2/2006 |
| RU | 2364660 | C1 | 8/2009 |
| RU | 2368695 | C1 | 9/2009 |
| RU | 2392348 | C2 | 6/2010 |
| RU | 2393936 | C1 | 7/2010 |
| SU | 534518 | A1 | 1/1977 |
| SU | 631234 | A | 11/1978 |
| SU | 1077328 | A | 5/1982 |
| SU | 1088397 | A1 | 2/1991 |
| UA | 38805 | A | 5/2001 |
| UA | 40862 | A | 8/2001 |
| UA | A200613448 | | 6/2008 |
| WO | WO 98/17386 | A1 | 4/1998 |
| WO | WO 98/17836 | A1 | 4/1998 |
| WO | WO 98/22629 | A | 5/1998 |
| WO | WO 02/36847 | A2 | 5/2002 |
| WO | WO 02/070763 | A1 | 9/2002 |
| WO | WO 02/086172 | A1 | 10/2002 |
| WO | WO 02/090607 | A1 | 11/2002 |
| WO | WO 2004/101838 | A1 | 11/2004 |
| WO | WO 2007/084178 | A2 | 7/2007 |
| WO | WO 2007/114439 | A1 | 10/2007 |
| WO | WO 2007/142379 | A1 | 12/2007 |
| WO | WO 2008/017257 | A1 | 2/2008 |
| WO | WO 2010/084883 | A1 | 7/2010 |
| WO | WO 2012/063504 | A1 | 5/2012 |
| WO | WO 2012/147742 | A1 | 11/2012 |
| WO | WO 2013/081770 | A1 | 6/2013 |
| WO | WO 2013/130139 | A2 | 9/2013 |

OTHER PUBLICATIONS

ATI 425® Alloy, Grade 38, Titanium Alloy, UNS R54250, Technical Data Sheet, Version 1, Nov. 25, 2013, pp. 1-6.

Beal et al., "Forming of Titanium and Titanium Alloys—Cold Forming", ASM Handbook, 2006, ASM International, Revised by ASM Committee on Forming Titanium Alloys, vol. 14B, 2 pages.

Craighead et al., "Ternary Alloys of Titanium", Journal of Metals, Mar. 1950, Transactions AIME, vol. 188, pp. 514-538.

Craighead et al., "Titanium Binary Alloys", Journal of Metals, Mar. 1950, Transactions AIME, vol. 188, pp. 485-513.

Diderrich et al., "Addition of Cobalt to the Ti—6Al—4V Alloy", Journal of Metals, May 1968, pp. 2937.

Donachie Jr., M.J., "Heat Treating Titanium and Its Alloys", Heat Treating Process, Jun./Jul. 2001, pp. 47-49, 52-53, and 56-57.

Hsieh, Chih-Chun and Weite Wu, "Overview of Intermetallic Sigma Phase Precipitation in Stainless Steels", ISRN Metallurgy, vol. 2012, 2012, pp. 1-16.

Swann, P.R. and J. G. Parr, "Phase Transformations in Titanium-Rich Alloys of Titanium and Cobalt", Transactions of the Metallurgical Society of AIME, Apr. 1958, pp. 276-279.

Yakymyshyn et al., "The Relationship between the Constitution and Mechanical Properties of Titanium-Rich Alloys of Titanium and Cobalt", 1961, vol. 53, pp. 283-294.

Bar definition, ASM Materials Engineering Dictionary, J.R. Davis Ed., ASM International, Materials Park, OH (1992) p. 32.

Billet definition, ASM Materials Engineering Dictionary, J.R. Davis Ed., ASM International, Materials Park, OH (1992) p. 40.

Cogging definition, ASM Materials Engineering Dictionary, J.R. Davis Ed., ASM International, Materials Park, OH (1992) p. 79.

Open die press forging definition, ASM Materials Engineering Dictionary, J.R. Davis Ed., ASM International, Materials Park, OH (1992) pp. 298 and 343.

Thermomechanical working definition, ASM Materials Engineering Dictionary, J.R. Davis Ed., ASM International, Materials Park, OH (1992) p. 480.

Ductility definition, ASM Materials Engineering Dictionary, J.R. Davis Ed., ASM International, Materials Park, OH (1992) p. 131.

AFML-TR-76-80 Development of Titanium Alloy Casting Technology, Aug. 1976, 5 pages.

Office Action dated Dec. 23, 2014 in U.S. Appl. No. 12/691,952.

Office Action dated Apr. 23, 2015 in U.S. Appl. No. 12/691,952.

Office Action dated Nov. 28, 2014 in U.S. Appl. No. 12/885,620.

Advisory Action dated May 18, 2015 in U.S. Appl. No. 12/885,620.

Office Action dated Jun. 30, 2015 in U.S. Appl. No. 12/885,620.

Office Action dated May 27, 2015 in U.S. Appl. No. 12/838,674.

Office Action dated Oct. 6, 2014 in U.S. Appl. No. 12/903,851.

Office Action dated Jul. 15, 2015 in U.S. Appl. No. 12/903,851.

Office Action dated Jan. 21, 2015 in U.S. Appl. No. 13/792,285.

Notice of Allowance dated Oct. 24, 2014 in U.S. Appl. No. 13/844,545.

Notice of Allowance dated Feb. 6, 2015 in U.S. Appl. No. 13/844,545.

U.S. Appl. No. 14/594,300 filed Jan. 12, 2015.

Office Action dated Jun. 3, 2015 in U.S. Appl. No. 13/714,465.

Office Action dated Jul. 8, 2015 in U.S. Appl. No. 13/714,465.

Office Action dated Jun. 26, 2015 in U.S. Appl. No. 13/777,066.

"Allvac TiOsteum and TiOstalloy Beat Titanium Alloys", printed from www.allvac.com/allvac/pages/Titanium/TiOsteum.htm on Nov. 7, 2005.

(56) References Cited

OTHER PUBLICATIONS

"Datasheet: Timetal 21S", Alloy Digest, Advanced Materials and Processes (Sep. 1998), pp. 38-39.
"Heat Treating of Nonferrous Alloys: Heat Treating of Titanium and Titanium Alloys," Metals Handbook, ASM Handbooks Online (2002).
"Stryker Orthopaedics TMZF® Alloy (UNS R58120)", printed from www.allvac.com/pages/Titanium/UNSR58120.htm on Nov. 7, 2005.
"Technical Data Sheet: Allvac® Ti—15Mo Beta Titanium Alloy" (dated Jun. 16, 2004).
"ASTM Designation F1801-97 Standard Practice for Corrosion Fatigue Testing of Metallic Implant Materials" ASTM International (1997) pp. 876-880.
"ASTM Designation F2066-01 Standard Specification for Wrought Titanium-15 Molybdenum Alloy for Surgical Implant Applications (UNS R58150)," ASTM International (2000) pp. 1-4.
AL-6XN® Alloy (UNS N08367) Allegheny Ludlum Corporation, 2002, 56 pages.
Allegheny Ludlum, "High Performance Metals for Industry, High Strength, High Temperature, and Corrosion-Resistant Alloys", (2000) pp. 1-8.
Allvac, Product Specification for "Allvac Ti—15 Mo," available at http://www.allvac.com/allvac/pages/Titanium/Ti15MO.htm, last visited Jun. 9, 2003 p. 1 of 1.
Altemp® A286 Iron-Base Superalloy (UNS Designation S66286) Allegheny Ludlum Technical Data Sheet Blue Sheet, 1998, 8 pages.
ASM Materials Engineering Dictionary, J.R. Davis Ed., ASM International, Materials Park, OH (1992) p. 39.
ATI Datalloy 2 Alloy, Technical Data Sheet, ATI Allvac, Monroe, NC, SS-844, Version1, Sep. 17, 2010, 8 pages.
ATI 690 (UNS N06690) Nickel-Base, ATI Allvac, Oct. 5, 2010, 1 page.
Isothermal forging definition, ASM Materials Engineering Dictionary, J.R. Davis ed., Fifth Printing, Jan. 2006, ASM International, p. 238.
Isothermal forging, printed from http://thelibraryofmanufacturing.com/isothermal_forging.html, accessed Jun. 5, 2013, 3 pages.
Adiabatic definition, ASM Materials Engineering Dictionary, J.R. Davis ed., Fifth Printing, Jan. 2006, ASM International, p. 9.
Adiabatic process—Wikipedia, the free encyclopedia, printed from http://en.wikipedia.org/wiki/Adiabatic_process, accessed May 21, 2013, 10 pages.
ASTM Designation F 2066-01, "Standard Specification for Wrought Titanium-15 Molybdenum Alloy for Surgical Implant Applications (UNS R58150)", May 2001, 7 pages.
ATI 6-2-4-2™ Alloy Technical Data Sheet, Version 1, Feb. 26, 2012, 4 pages.
ATI 6-2-4-6™ Titanium Alloy Data Sheet, accessed Jun. 26, 2012.
ATI 425, High-Strength Titanium Alloy, Alloy Digest, ASM International, Jul. 2004, 2 pages.
ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
ATI 425® Alloy, Technical Data Sheet, retrieved from http://web.archive.org/web/20100703120218/http://www.alleghenytechnologies.com/AT1425/specifications/datasheet.asp, Jul. 3, 2010, Way Back Machine, 5 pages.
ATI 425®-MIL Alloy, Technical Data Sheet, Version 1, May 28, 2010, pp. 1-5.
ATI 425®-MIL Alloy, Technical Data Sheet, Version 2, Aug. 16, 2010, 5 pages.
ATI 425®-MIL Titanium Alloy, Mission Critical Metallics®, Version 3, Sep. 10, 2009, pp. 1-4.
ATI 425® Titanium Alloy, Grade 38 Technical Data Sheet, Version 1, Feb. 1, 2012, pp. 1-6.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti—15Mo Beta Titanium Alloy Technical Data Sheet, ATI Allvac, Monroe, NC, Mar. 21, 2008, 3 pages.
ATI Titanium 6Al—2Sn—4Zr—2Mo Alloy, Technical Data Sheet, Version 1, Sep. 17, 2010, pp. 1-3.
ATI Titanium 6Al—4V Alloy, Mission Critical Metallics®, Technical Data Sheet, Version 1, Apr. 22, 2010, pp. 1-3.
ATI Wah Chang, ATI™ 425 Titanium Alloy (Ti—4Al—2.5V—1.5Fe-0.2502), Technical Data Sheet, 2004, pp. 1-5.
ATI Wah Chang, Titanium and Titanium Alloys, Technical Data Sheet, 2003, pp. 1-16.
Beal et al., "Forming of Titanium and Titanium Alloys—Cold Forming", ASM Handbook, 2006, ASM International, vol. 14B, 2 pages.
Bewlay, et al., "Superplastic roll forming of Ti alloys", Materials and Design, 21, 2000, pp. 287-295.
Bowen, A. W., "Omega Phase Embrittlement in Aged Ti—15%Mo," Scripta Metallurgica, vol. 5, No. 8 (1971) pp. 709-715.
Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Cain, Patrick, "Warm forming aluminum magnesium components; How it can optimize formability, reduce springback", Aug. 1, 2009, from http://www.thefabricatorcom/article/presstechnology/warm-forming-aluminum-magnesium-components, 3 pages.
Callister, Jr., William D., Materials Science and Engineering, An Introduction, Sixth Edition, John Wiley & Sons, pp. 180-184 (2003).
Desrayaud et al., "A novel high straining process for bulk materials—The development of a multipass forging system by compression along three axes", Journal of Materials Processing Technology, 172, 2006, pp. 152-158.
DiDomizio, et al., "Evaluation of a Ni—20Cr Alloy Processed by Multi-axis Forging", Materials Science Forum vols. 503-504, 2006, pp. 793-798.
Disegi, J. A., "Titanium Alloys for Fracture Fixation Implants," Injury International Journal of the Care of the Injured, vol. 31 (2000) pp. S-D14-S-D17.
Disegi, John, Wrought Titanium—15% Molybdenum Implant Material, Original Instruments and Implants of the Association for the Study of International Fixation—AO ASIF, Oct. 2003.
Donachie Jr., M.J., "Titanium a Technical Guide" 1988, ASM, pp. 39 and 46-50.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. By R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys-Solution Treating and Aging", ASM Handbook, 1991, ASM International, vol. 4, pp. 1-8.

(56) References Cited

OTHER PUBLICATIONS

Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2001, retrieved from http://www.ohiolink.edu/etd/send-pdf.cgi/harper%20megan%20lynn.pdf?acc_num=osu1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti—Mo Alloys" Biomaterials, vol. 20 (1999) pp. 2115-2122.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.
Imperial Metal Industries Limited, Product Specification for "IMI Titanium 205", The Kynoch Press (England) pp. 1-5. (publication date unknown).
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials for Surgical Implant Devices," BONEZone, Fall (2002) p. 5-9 and Table.
Long, M. et al., "Friction and Surface Behavior of Selected Titanium Alloys During Reciprocating-Sliding Motion", WEAR, 249(1-2), Jan. 17, 2001, 158-168.
Lütjering, G. and J.C. Williams, Titanium, Springer, New York (2nd ed. 2007) p. 24.
Lütjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications," Journal of ASTM International, vol. 2, Issue 9 (Oct. 2005) (published online Aug. 17, 2005).
Marquardt, Brian, "Characterization of Ti—15Mo for Orthopaedic Applications, "TMS 2005 Annual Meeting: Technical Program, San Francisco, CA, Feb. 13-17, 2005 Abstract, p. 239.
Marquardt, Brian, "Ti—15Mo Beta Titanium Alloy Processed for High Strength Orthopaedic Applications," Program and Abstracts for the Symposium on Titanium, Niobium, Zirconium, and Tantalum for Medical and Surgical Applications, Washington, D.C., Nov. 9-10, 2004 Abstract, p. 11.
Marte et al., "Structure and Properties of Ni—20Cr Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray, J.L., et al., Binary Alloy Phase Diagrams, Second Edition, vol. 1, Ed. Massalski, Materials Park, OH; ASM International; 1990, p. 547.
Murray, J.L., The Mn—Ti (Manganese-Titanium) System, Bulletin of Alloy Phase Diagrams, vol. 2, No. 3 (1981) p. 334-343.
Myers, J., "Primary Working, A lesson from Titanium and its Alloys," ASM Course Book 27 Lesson, Test 9, Aug. 1994, pp. 3-4.
Naik, Uma M. et al., "Omega and Alpha Precipitation in Ti—15Mo Alloy, "Titanium '80 Science and Technology—Proceedings of the 4th International Conference on Titanium, H. Kimura & O. Izumi Eds. May 19-22, 1980 pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti—15Mo—5Zr—3Al", Materials Properties Handbook: Titanium Alloys, eds. R. Boyer et al., ASM International, Materials Park, OH, 1994, p. 949.
Nutt, Michael J. et al., "The Application of Ti-15 Beta Titanium Alloy in High Strength Structural Orthopaedic Applications," Program and Abstracts for the Symposium on Titanium Niobium, Zirconium, and Tantalum for Medical and Surgical Applications, Washington, D.C., Nov. 9-10, 2004 Abstract, p. 12.
Nyakana, et al., "Quick Reference Guide for β Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in β Ti—15Mo," Titanium '80 Science and Technology—Proceedings of the 4th International Conference on Titanium, H. Kimura & O. Izumi Eds. May 19-22 (1980) pp. 1344-1350.
Prasad, Y.V.R.K. et al. "Hot Deformation Mechanism in Ti—6Al—4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.
Roach, M.D., et al., "Comparison of the Corrosion Fatigue Characteristics of CPTi-Grade 4, Ti—6Al—4V ELI, Ti—6A1-7 Nb, and Ti-15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et at., "Longitudinal flux indication heating of slabs, bars and strips is no longer "Black Magic:" II", Industrial Heating, Feb. 1995, pp. 46-48 and 50-51.
Russo, P.A., "Influence of Ni and Fe on the Creep of Beta Annealed Ti-6242S", Titanium '95: Science and Technology, pp. 1075-1082.
SAE Aerospace Material Specification 4897A (issued Jan. 1997, revised Jan. 2003).

(56) References Cited

OTHER PUBLICATIONS

SAE Aerospace, Aerospace Material Specification, Titanium Alloy Bars, Forgings and Forging Stock, 6.0Al-4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al-4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al—2.5V—1.5Fe, Annealed, AMS 6946A, Issued Oct. 2006, Revised Jun. 2007, pp. 1-7.
Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
SPS Titanium™ Titanium Fasteners, SPS Technologies Aerospace Fasteners, 2003, 4 pages.
Standard Specification for Wrought Titanium-6Aluminum-4Vanadium Alloy for Surgical Implant Applications (UNS R56400), Designation: F 1472-99, ASTM 1999, pp. 1-4.
Takemoto Yet al., "Tensile Behavior and Cold Workability of Ti—Mo Alloys", Materials Transactions Japan Inst. Metals Japan, vol. 45, No. 5, May 2004, pp. 1571-1576.
Tamarisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Tamirisakandala et al., "Effect of boron on the beta transus of Ti—6Al—4V alloy", Scripta Materialia, 53, 2005, pp. 217-222.
Tamirisakandala et al., "Powder Metallurgy Ti—6Al—4V—xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Technical Presentation: Overview of MMPDS Characterization of ATI 425 Alloy, 2012, 1 page.
TIMET 6-6-2 Titanium Alloy (Ti—6Al—6V—2Sn), Annealed, accessed Jun. 27, 2012.
TIMET Timetal® 6-2-4-2 (Ti—6Al—2Sn—4Zr—2Mo—0.08Si) Titanium Alloy datasheet, accessed Jun. 26, 2012.
TIMET Timetal® 6-2-4-6 Titanium Alloy (Ti—6Al—2Sn—4Zr—6Mo), Typical, accessed Jun. 26, 2012.
Tokaji, Keiro et al., "The Microstructure Dependence of Fatigue Behavior in Ti—15Mo—5Zr—3Al Alloy," Materials Science and Engineering A., vol. 213 (1996) pp. 86-92.
Two new α-β titanium alloys, KS Ti-9 for sheet and KS EL-F for forging, with mechanical properties comparable to Ti—6Al—4V, Oct. 8, 2002, ITA 2002 Conference in Orlando, Hideto Oyama, Titanium Technology Dept., Kobe Steel, Ltd., 16 pages.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. by T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AeroMat Conference & Exposition, May 18, 2006, 2 pages.
Zhang et al., "Simulation of slip band evolution in duplex Ti—6Al—4V", Acta Materialia, vol. 58, (2010), Nov. 26, 2009, pp. 1087-1096.
Zherebtsov et al., "Production of submicrocrystalline structure in large-scale Ti—6Al—4V billet by warm severe deformation processing", Scripta Materialia, 51, 2004, pp. 1147-1151.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6Al—4V, Annealed, AMS 4911L, Jun. 2007, SAE Aerospace, Aerospace Material Specification, 7 pages.
Office Action dated Oct. 19, 2011 in U.S. Appl. No. 12/691,952.
Office Action dated Feb. 2, 2012 in U.S. Appl. No. 12/691,952.
Office Action dated Feb. 20, 2004 in U.S. Appl. No. 10/165,348.
Office Action dated Oct. 26, 2004 in U.S. Appl. No. 10/165,348.
Office Action dated Feb. 16, 2005 in U.S. Appl. No. 10/165,348.
Office Action dated Jul. 25, 2005 in U.S. Appl. No. 10/165,348.
Office Action dated Jan. 3, 2006 in U.S. Appl. No. 10/165,348.
Office Action dated Dec. 16, 2004 in U.S. Appl. No. 10/434,598.
Office Action dated Aug. 17, 2005 in U.S. Appl. No. 10/434,598.
Office Action dated Dec. 19, 2005 in U.S. Appl. No. 10/434,598.
Office Action dated Sep. 6, 2006 in U.S. Appl. No. 10/434,598.
Office Action dated Aug. 6, 2008 in U.S. Appl. No. 11/448,160.
Office Action dated Jan. 13, 2009 in U.S. Appl. No. 11/448,160.
Notice of Allowance dated Apr. 13, 2010 in U.S. Appl. No. 11/448,160.
Notice of Allowance dated Sep. 20, 2010 in U.S. Appl. No. 11/448,160.
Office Action dated Sep. 26, 2007 in U.S. Appl. No. 11/057,614.
Office Action dated Jan. 10, 2008 in U.S. Appl. No. 11/057,614.
Office Action dated Aug. 29, 2008 in U.S. Appl. No. 11/057,614.
Office Action dated Aug. 11, 2009 in U.S. Appl. No. 11/057,614.
Office Action dated Jan. 14, 2010 in U.S. Appl. No. 11/057,614.
Interview summary dated Apr. 14, 2010 in U.S. Appl. No. 11/057,614.
Office Action dated Jun. 21, 2010 in U.S. Appl. No. 11/057,614.
Notice of Allowance dated Sep. 3, 2010 in U.S. Appl. No. 11/057,614.
Office Action dated Apr. 1, 2010 in U.S. Appl. No. 11/745,189.
Interview summary dated Jun. 3, 2010 in U.S. Appl. No. 11/745,189.
Interview summary dated Jun. 15, 2010 in U.S. Appl. No. 11/745,189.
Office Action dated Nov. 24, 2010 in U.S. Appl. No. 11/745,189.
Interview summary dated Jan. 6, 2011 in U.S. Appl. No. 11/745,189.
Notice of Allowance dated Jun. 27, 2011 in U.S. Appl. No. 11/745,189.
Office Action dated Jan. 11, 2011 in U.S. Appl. No. 12/911,947.
Office Action dated Aug. 4, 2011 in U.S. Appl. No. 12/911,947.
Office Action dated Nov. 16, 2011 in U.S. Appl. No. 12/911,947.
Advisory Action dated Jan. 25, 2012 in U.S. Appl. No. 12/911,947.

(56) References Cited

OTHER PUBLICATIONS

Notice of Panel Decision from Pre-Appeal Brief Review dated Mar. 28, 2012 in U.S. Appl. No. 12/911,947.
Office Action dated Apr. 5, 2012 in U.S. Appl. No. 12/911,947.
Office Action dated Sep. 19, 2012 in U.S. Appl. No. 12/911,947.
Advisory Action dated Nov. 29, 2012 in U.S. Appl. No. 12/911,947.
Office Action dated May 31, 2013 in U.S. Appl. No. 12/911,947.
Office Action dated Jan. 3, 2011 in U.S. Appl. No. 12/857,789.
Office Action dated Jul. 27, 2011 in U.S. Appl. No. 12/857,789.
Advisory Action dated Oct. 7, 2011 in U.S. Appl. No. 12/857,789.
Notice of Allowance dated Jul. 1, 2013 in U.S. Appl. No. 12/857,789.
Office Action dated Nov. 14, 2012 in U.S. Appl. No. 12/885,620.
Office Action dated Jun. 13, 2013 in U.S. Appl. No. 12/885,620.
Office Action dated Nov. 14, 2012 in U.S. Appl. No. 12/888,699.
Office Action dated Oct. 3, 2012 in U.S. Appl. No. 12/838,674.
Office Action dated Jul. 18, 2013 in U.S. Appl. No. 12/838,674.
Office Action dated Sep. 26, 2012 in U.S. Appl. No. 12/845,122.
Notice of Allowance dated Apr. 17, 2013 in U.S. Appl. No. 12/845,122.
Office Action dated Dec. 24, 2012 in U.S. Appl. No. 13/230,046.
Notice of Allowance dated Jul. 31, 2013 in U.S. Appl. No. 13/230,046.
Office Action dated Dec. 26, 2012 in U.S. Appl. No. 13/230,143.
Notice of Allowance dated Aug. 2, 2013 in U.S. Appl. No. 13/230,143.
Office Action dated Mar. 1, 2013 in U.S. Appl. No. 12/903,851.
Office Action dated Mar. 25, 2013 in U.S. Appl. No. 13/108,045.
Office Action dated Apr. 16, 2013 in U.S. Appl. No. 13/150,494.
Office Action dated Jun. 14, 2013 in United States Application No. 13/150,494.
U.S. Appl. No. 13/777,066, filed Feb. 26, 2013.
U.S. Appl. No. 13/331,135, filed Dec. 20, 2011.
U.S. Appl. No. 13/792,285, filed Mar. 11, 2013.
U.S. Appl. No. 13/844,545, filed Mar. 15, 2013.
Office Action dated Jan. 23, 2013 in U.S. Appl. No. 12/882,538.
Office Action dated Feb. 8, 2013 in U.S. Appl. No. 12/882,538.
Notice of Allowance dated Jun. 24, 2013 in U.S. Appl. No. 12/882,538.
Notice of Allowance dated Oct. 4, 2013 in U.S. Appl. No. 12/911,947.
Notice of Allowance dated Nov. 5, 2013 in U.S. Appl. No. 13/150,494.
U.S. Appl. No. 13/933,222, filed Mar. 15, 2013.
Office Action dated Sep. 6, 2013 in U.S. Appl. No. 13/933,222.
Notice of Allowance dated Oct. 1, 2013 in U.S. Appl. No. 13/933,222.
U.S. Appl. No. 14/077,699, filed Nov. 12, 2013.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI Al-6XN® Alloy (UNS N08367), ATI Allegheny Ludlum, 2010, 59 pages.
ATI 800™/ATI 800H™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Office Action dated Nov. 19, 2013 in U.S. Appl. No. 12/885,620.
ASTM Designation F 2066/F2066M-13, "Standard Specification for Wrought Titanium-15 Molybdenum Alloy for Surgical Implant Applications (UNS R58150)", Nov. 2013, 6 pages.
Boyko et al., "Modeling of the Open-Die and Radial Forging Processes for Alloy 718", Superalloys 718, 625 and Various Derivatives: Proceedings of the International Symposium on the Metallurgy and Applications of Superalloys 718, 625 and Various Derivatives, held Jun. 23, 1992, pp. 107-124.
Advisory Action Before the Filing of an Appeal Brief dated Jan. 30, 2014 in U.S. Appl. No. 12/885,620.
Office Action dated Jun. 18, 2014 in U.S. Appl. No. 12/885,620.
Office Action dated Jan. 16, 2014 in U.S. Appl. No. 12/903,851.
Office Action dated Jan. 17, 2014 in U.S. Appl. No. 13/108,045.
Supplemental Notice of Allowability dated Jan. 17, 2014 in U.S. Appl. No. 13/150,494.
Notice of Allowance dated May 6, 2014 in U.S. Appl. No. 13/933,222.
ASM Materials Engineering Dictionary, "Blasting or Blast Cleaning," J.R. Davis Ed., ASM International, Materials Park, OH (1992) p. 42.
Beal et al., "Forming of Titanium and Titanium Alloys-Cold Forming", ASM Handbook, 2006, vol. 14B, pp. 656-669.
Glazunov et al., Structural Titanium Alloys, Moscow, Metallurgy, 1974, pp. 264-283.
Novikov et al., 17.2.2 Deformable ($\alpha + \beta$) alloys, Chapter 17, Titanium and its Alloys, Metal Science, vol. II Thermal Treatment of the Alloy, Physical Matallurgy, 2009, pp. 357-360.
Valiev et al., "Nanostructured materials produced by sever plastic deformation", Moscow, LOGOS, 2000.
Li et al., "The optimal determination of forging process parameters for Ti—6.5Al—3.5Mo—1.5Zr—0.3Si alloy with thick lamellar microstructure in two phase field based on P-map", Journal of Materials Processing Technology, vol. 210, Issue 2, Jan. 19, 2010, pp. 370-377.
Office Action dated Jul. 28, 2015 in U.S. Appl. No. 12/691,952.
Applicant Initiated Interview Summary dated Sep. 1, 2015 in U.S. Appl. No. 12/838,674.
Notice of Allowance dated Sep. 25, 2015 in U.S. Appl. No. 12/838,674.
Office Action dated Jun. 4, 2015 in U.S. Appl. No. 13/792,285.
Response to Rule 312 Communication dated Oct. 20, 2015 in U.S. Appl. No. 13/792,285.
Notice of Allowance dated Sep. 2, 2015 in U.S. Appl. No. 13/714,465.
Response to Rule 312 Communication dated Sep. 29, 2015 in U.S. Appl. No. 13/714,465.
Response to Rule 312 Communication dated Oct. 8, 2015 in U.S. Appl. No. 13/714,465.
Office Action dated Oct. 5, 2015 in U.S. Appl. No. 13/777,066.
Office Action dated Aug. 19, 2015 in U.S. Appl. No. 13/844,196.
Office Action dated Oct. 15, 2015 in U.S. Appl. No. 13/844,196.
Office Action dated Oct. 2, 2015 in U.S. Appl. No. 14/073,029.
Office Action dated Oct. 28, 2015 in U.S. Appl. No. 14/093,707.
Buijk, A., "Open-Die Forging Simulation", Forge Magazine, Dec. 1, 2013, 5 pages.
Herring, D., "Grain Size and Its Influence on Materials Properties", IndustrialHeating.com, Aug. 2005, pp. 20 and 22.
INCONEL® alloy 600, Special Metals Corporation, www.specialmetals.com, Sep. 2008, 16 pages.
Yaylaci et al., "Cold Working & Hot Working & Annealing", http://yunus.hacettepe.edu.tr/~selis/teaching/WEBkmu479/Ppt/kmu479Presentations2010/Cold_Hot_Working_Annealing.pdf, 2010, 41 pages.
Superaustenitic, http://www.atimetals.com/products/Pages/superaustenitic.aspx, Nov. 9, 2015, 3 pages.
French, D., "Austenitic Stainless Steel", The National Board of Boiler and Pressure Vessel Inspectors Bulletin, 1992, 3 pages.
Acorn Magazine, outokumpu, NACE International, Feb. 2013, 16 pages.
ATI A286™ Iron Based Superalloy (UNS S66286) Technical Data Sheet, Allegheny Technologies Incorporated, Version 1, Apr. 17, 2012, 9 pages.
ATI A286™ (UNS S66286) Technical Data Sheet, Allegheny Technologies Incorporated, Version 1, Mar. 14, 2012, 3 pages.
Corrosion-Resistant Titanium, Technical Data Sheet, Allegheny Technologies Incorporated, Version 1, Feb. 29, 2012, 5 pages.

(56) References Cited

OTHER PUBLICATIONS

ATI 3-2.5™ Titanium (Ti Grade 9) Technical Data Sheet, ATI Wah Chang, 2010, 4 pages.
Grade 9 Ti 3Al 2.5V Alloy (UNS R56320), Jul. 30, 2013, http://www.azom.com/article.aspx?ArticleID=9337, 3 pages.
ATI Ti—6Al—4V, Grade 5, Titanium Alloy (UNS R56400) Technical Data Sheet, Allegheny Technologies Incorporated, Version 1, Jan. 31, 2012, 4 pages.
Panin et al., "Low-cost Titanium Alloys for Titanium-Polymer Layered Composites", 29th Congress of the International Council of the Aeronautical Sciences, St. Petersburg, Russia, Sep. 7, 2014, 4 pages.
Grade Ti—4.5Al—3V—2Mo—2Fe Alloy, Jul. 9, 2013, http://www.azom.com/article.aspx?ArticleID=9448, 2 pages.
Garside et al., "Mission Critical Metallics® Recent Developments in High-Strength Titanium Fasteners for Aerospace Applications", ATI, 2013, 21 pages.
Foltz et al., "Recent Developments in High-Strength Titanium Fasteners for Aerospace Applications", ATI, Oct. 22, 2014, 17 pages.
Kosaka et al., "Superplastic Forming Properties of Timetal® 54M", Henderson Technical Laboratory, Titanium Metals Corporation, ITA, Oct. 2010, Orlando, Florida, 18 pages.
ATI Datalloy HP™ Alloy, UNS N08830, Technical Data Sheet Version 1, Apr. 14, 2015, 6 pages.
ATI Datalloy 2® Alloy, Technical Data Sheet, Version 1, Feb. 20, 2014, 6 pages.
Handa, Sukhdeep Singh, "Precipitation of Carbides in a Ni-based Superalloy", Degree Project for Master of Science with Specialization in Manufacturing Department of Engineering Science, University West, Jun. 30, 2014, 42 pages.
Office Action dated Feb. 17, 2016 in U.S. Appl. No. 12/691,952.
Office Action dated Jun. 28, 2016 in U.S. Appl. No. 12/691,952.
Notice of Abandonment dated Jan. 29, 2016 in U.S. Appl. No. 12/885,620.
Office Action dated Mar. 30, 2016 in U.S. Appl. No. 13/108,045.
Notice of Allowance dated Sep. 16, 2015 in U.S. Appl. No. 13/792,285.
Advisory Action Before the Filing of an Appeal Brief dated Mar. 17, 2016 in U.S. Appl. No. 13/777,066.
Office Action dated Mar. 17, 2016 in U.S. Appl. No. 14/093,707.
Advisory Action Before the Filing of an Appeal Brief dated Jun. 10, 2016 in U.S. Appl. No. 14/093,707.
Notice of Third-Party Submission dated Dec. 16, 2015 in U.S. Appl. No. 14/077,699.
Office Action dated Mar. 16, 2016 in U.S. Appl. No. 15/005,281.
U.S. Appl. No. 14/948,941, filed Nov. 23, 2015.
Office Action dated Apr. 5, 2016 in U.S. Appl. No. 14/028,588.
Office Action dated Apr. 13, 2016 in U.S. Appl. No. 14/083,759.
Office Action dated May 6, 2016 in U.S. Appl. No. 14/083,759.
Titanium Alloy Guide, RMI Titanium Company, Jan. 2000, 45 pages.
Wanhill et al, "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Grade 6Al 2Sn 4Zr 6Mo Titanium Alloy (UNS R56260), AZoM, http://www.azom.com/article.aspx?ArticleID=9305, Jun. 20, 2013, 4 pages.
Gammon et al., "Metallography and Microstructures of Titanium and Its Alloys", ASM Handbook, vol. 9: Metallography and Microstructures, ASM International, 2004, pp. 899-917.
Rui-gang Deng, et al. "Effects of Forging Process and Following Heat Treatment on Microstructure and Mechanical Properties of TC11 Titanium Alloy," Materials for Mechanical Engineering, vol. 35. No. 11, Nov. 2011, 5 pages. (English abstract included).
Applicant-Initiated Interview Summary dated Aug. 22, 2016 in U.S. Appl. No. 12/691,952.
Advisory Action Before the Filing of an Appeal Brief dated Aug. 30, 2016 in U.S. Appl. No. 12/691,952.
Examiner's Answer to Appeal Brief dated Oct. 27, 2016 in U.S. Appl. No. 12/903,851.
Office Action dated Sep. 9, 2016 in U.S. Appl. No. 13/108,045.
Office Action dated Jul. 22, 2016 in U.S. Appl. No. 13/777,066.
Office Action dated Aug. 12, 2016 in U.S. Appl. No. 14/073,029.
Office Action dated Sep. 30, 2016 in U.S. Appl. No. 14/093,707.
Office Action dated Jul. 25, 2016 in U.S. Appl. No. 14/077,699.
Office Action dated Aug. 16, 2016 in U.S. Appl. No. 14/077,699.
Office Action dated Oct. 25, 2016 in U.S. Appl. No. 14/077,699.
Office Action dated Aug. 26, 2016 in U.S. Appl. No. 15/005,281.
Office Action dated Aug. 8, 2016 in U.S. Appl. No. 14/028,588.
Advisory Action dated Oct. 14, 2016 in U.S. Appl. No. 14/028,588.
Applicant Initiated Interview Summary dated Oct. 27, 2016 in U.S. Appl. No. 14/028,588.
Notice of Allowance dated Oct. 13, 2016 in U.S. Appl. No. 14/083,759.
Srinivasan et al., "Rolling of Plates and Sheets from As-Cast Ti—6Al—4V-0.1 B", Journal of Materials Engineering and Performance", vol. 18.4, Jun. 2009, pp. 390-398.
Office Action dated Apr. 28, 2017 in U.S. Appl. No. 12/691,952.
Advisory Action dated Mar. 7, 2017 in U.S. Appl. No. 13/108,045.
Office Action dated Oct. 12, 2016 in U.S. Appl. No. 13/777,066.
Office Action dated May 18, 2017 in U.S. Appl. No. 13/777,066.
Office Action dated Jun. 14, 2017 in U.S. Appl. No. 14/073,029.
Notice of Allowance dated Jan. 13, 2017 in U.S. Appl. No. 14/093,707.
Supplemental Notice of Allowance dated Jan. 27, 2017 in U.S. Appl. No. 14/093,707.
Supplemental Notice of Allowance dated Feb. 10, 2017 in U.S. Appl. No. 14/093,707.
Supplemental Notice of Allowability dated Mar. 1, 2017 in U.S. Appl. No. 14/093,707.
Advisory Action dated Nov. 30, 2016 in U.S. Appl. No. 14/077,699.
Notice of Panel Decision from Pre-Appeal Brief Review dated Feb. 24, 2017 in U.S. Appl. No. 15/005,281.
Office Action dated Mar. 2, 2017 in U.S. Appl. No. 15/005,281.
Office Action dated Mar. 15, 2017 in U.S. Appl. No. 14/028,588.
U.S. Appl. No. 15/348,140, filed Nov. 10, 2016.
Notice of Allowance dated Dec. 16, 2016 in U.S. Appl. No. 14/922,750.
Notice of Allowance dated Feb. 28, 2017 in U.S. Appl. No. 14/922,750.
Office Action dated Apr. 10, 2017 in U.S. Appl. No. 14/594,300.
Office Action dated May 25, 2017 in U.S. Appl. No. 14/594,300.

* cited by examiner

THERMOMECHANICAL PROCESSING OF ALPHA-BETA TITANIUM ALLOYS

STATEMENT REGARDING FEDERALLY SPONSORED RESEARCH OR DEVELOPMENT

This invention was made with United States government support under NIST Contract Number 70NANB7H7038, awarded by the National Institute of Standards and Technology (NIST), United States Department of Commerce. The United States government may have certain rights in the invention.

BACKGROUND OF THE TECHNOLOGY

Field of the Technology

The present disclosure relates to methods for processing alpha-beta titanium alloys. More specifically, the disclosure is directed to methods for processing alpha-beta titanium alloys to promote a fine grain, superfine grain, or ultrafine grain microstructure.

Description of the Background of the Technology

Alpha-beta titanium alloys having fine grain (FG), superfine grain (SFG), or ultrafine grain (UFG) microstructure have been shown to exhibit a number of beneficial properties such as, for example, improved formability, lower forming flow-stress (which is beneficial for creep forming), and higher yield stress at ambient to moderate service temperatures.

As used herein, when referring to the microstructure of titanium alloys: the term "fine grain" refers to alpha grain sizes in the range of 15 μm down to greater than 5 μm; the term "superfine grain" refers to alpha grain sizes of 5 μm down to greater than 1.0 μm; and the term "ultrafine grain" refers to alpha grain sizes of 1.0 μm or less.

Known commercial methods of forging titanium and titanium alloys to produce coarse grain or fine grain microstructures employ strain rates of 0.03 $s^{-1}$ to 0.10 $s^{-1}$ using multiple reheats and forging steps.

Known methods intended for the manufacture of fine grain, very fine grain, or ultrafine grain microstructures apply a multi-axis forging (MAF) process at an ultra-slow strain rate of 0.001 $s^{-1}$ or slower (see, for example, G. Salishchev, et. al., *Materials Science Forum*, Vol. 584-586, pp. 783-788 (2008)). The generic MAF process is described in, for example, C. Desrayaud, et. al, *Journal of Materials Processing Technology*, 172, pp. 152-156 (2006). In addition to the MAF process, it is known that an equal channel angle extrusion (ECAE) otherwise referred to as equal channel angle pressing (ECAP) process can be used to attain fine grain, very fine grain, or ultrafine grain microstructures in titanium and titanium alloys. A description of an ECAP process is found, for example in V. M. Segal, USSR Patent No. 575892 (1977), and for Titanium and Ti-6-4, in S. L. Semiatin and D. P. DeLo, Materials and Design, Vol. 21, pp 311-322 (2000), However, the ECAP process also requires very low strain rates and very low temperatures in isothermal or near-isothermal conditions. By using such high force processes such as MAF and ECAP, any starting microstructure can eventually be transformed into an ultrafine grained microstructure. However, for economic reasons that are further described herein, only laboratory-scale MAF and ECAP processing is currently conducted.

The key to grain refinement in the ultra-slow strain rate MAF and the ECAP processes is the ability to continually operate in a regime of dynamic recrystallization that is a result of the ultra-slow strain rates used, i.e., 0.001 $s^{-1}$ or slower. During dynamic recrystallization, grains simultaneously nucleate, grow, and accumulate dislocations. The generation of dislocations within the newly nucleated grains continually reduces the driving force for grain growth, and grain nucleation is energetically favorable. The ultra-slow strain rate MAF and the ECAP processes use dynamic recrystallization to continually recrystallize grains during the forging process.

A method of processing titanium alloys for grain refinement is disclosed in International Patent Publication No. WO 98/17836 (the "WO '836 Publication"), which is incorporated by reference in its entirety herein. The method in the WO '836 Publication discloses heating and deforming an alloy to form fine-grained microstructure as a result of dynamic recrystallization.

Relatively uniform billets of ultrafine grain Ti-6-4 alloy (UNS R56400) can be produced using the ultra-slow strain rate MAF or ECAP processes, but the cumulative time taken to perform the MAF or ECAP steps can be excessive in a commercial setting. In addition, conventional large scale, commercially available open die press forging equipment may not have the capability to achieve the ultra-slow strain rates required in such embodiments and, therefore, custom forging equipment may be required for carrying out production-scale ultra-slow strain rate MAF or ECAP.

It is generally known that finer lamellar starting microstructures require less strain to produce globularized fine to ultrafine microstructures. However, while it has been possible to make laboratory-scale quantities of fine to ultrafine alpha-grain size titanium and titanium alloys by using isothermal or near-isothermal conditions, scaling up the laboratory-scale process may be problematic due to yield losses. Also, industrial-scale isothermal processing proves to be cost prohibitive due to the expense of operating the equipment. High yield techniques involving non-isothermal, open die processes prove difficult because of the very slow required forging speeds, which requires long periods of equipment usage, and because of cooling-related cracking, which reduces yield. Also, as-quenched, lamellar alpha structures exhibit low ductility, especially at low processing temperatures.

It is generally known that alpha-beta titanium alloys in which the microstructure is formed of globularized alpha-phase particles exhibit better ductility than alpha-beta titanium alloys having lamellar alpha microstructures. However, forging alpha-beta titanium alloys with globularized alpha-phase particles does not produce significant particle refinement. For example, once alpha-phase particles have coarsened to a certain size, for example, 10 μm or greater, it is nearly impossible using conventional techniques to reduce the size of such particles during subsequent thermomechanical processing, as observed by optical metallography.

One process for refining the microstructure of titanium alloys is disclosed in European Patent No. 1 546 429 B1 (the "EP '429 patent"), which is incorporated by reference herein in its entirety. In the process of the EP '429 patent, once alpha-phase has been globularized at high temperature, the alloy is quenched to create secondary alpha phase in the form of thin lamellar alpha-phase between relatively coarse globular alpha-phase particles. Subsequent forging at a temperature lower than the first alpha processing leads to globularization of the fine alpha lamellae into fine alpha-phase particles. The resulting microstructure is a mix of coarse and fine alpha-phase particles. Because of the coarse alpha-phase particles, the microstructure resulting from methods disclosed in the EP '429 patent does not lend itself to further grain refinement into a microstructure fully formed of ultrafine to fine alpha-phase grains.

U.S. Patent Publication No. 2012-0060981 A1 (the "U.S. '981 Publication"), which is incorporated by reference herein in its entirety, discloses an industrial scale-up to impart redundant work by means of multiple upset and draw forging steps (the "MUD Process"). The U.S. '981 Publication discloses starting structures comprising lamellar alpha structures generated by quenching from the beta-phase field of titanium or a titanium alloy. The MUD Process is performed at low temperatures to inhibit excessive particle growth during the sequence of alternate deformation and reheat steps. The lamellar starting stock exhibits low ductility at the low temperatures used and, scale-up for open-die forgings may be problematic with respect to yield.

It would be advantageous to provide a process for producing titanium alloys having fine, very fine, or ultrafine grain microstructure that accommodates higher strain rates, reduces necessary processing time, and/or eliminates the need for custom forging equipment.

SUMMARY

According to one non-limiting aspect of the present disclosure, a method of refining alpha-phase grain size in an alpha-beta titanium alloy comprises working an alpha-beta titanium alloy at a first working temperature within a first temperature range. The first temperature range is in an alpha-beta phase field of the alpha-beta titanium alloy. The alpha-beta titanium alloy is slow cooled from the first working temperature. On completion of working at and slow cooling from the first working temperature, the alpha-beta titanium alloy comprises a primary globularized alpha-phase particle microstructure. The alpha-beta titanium alloy subsequently is worked at a second working temperature within a second temperature range. The second working temperature is lower than the first working temperature and also is in the alpha-beta phase field of the alpha-beta titanium alloy.

In a non-limiting embodiment, subsequent to working at the second working temperature, the alpha-beta titanium alloy is worked at a third working temperature in a final temperature range. The third working temperature is lower than the second working temperature, and the third temperature range is in the alpha-beta phase field of the alpha-beta titanium alloy. After working the alpha-beta titanium alloy at the third working temperature, a desired refined alpha-phase grain size is attained.

In another non-limiting embodiment, after working the alpha-beta titanium alloy at the second working temperature, and prior to working the alpha-beta titanium alloy at the third working temperature, the alpha-beta titanium alloy is worked at one or more progressively lower fourth working temperatures. Each of the one or more progressively lower fourth working temperatures is lower than the second working temperature. Each of the one or more progressively lower fourth working temperatures is within one of a fourth temperature range and the third temperature range. Each of the fourth working temperatures is lower than the immediately preceding fourth working temperature. In a non-limiting embodiment, at least one of working the alpha-beta titanium alloy at the first temperature, working the alpha-beta titanium alloy at the second temperature, working the alpha-beta titanium alloy at the third temperature, and working the alpha-beta titanium alloy at one or more progressively lower fourth working temperatures comprises at least one open die press forging step. In another non-limiting embodiment, at least one of working the alpha-beta titanium alloy at the first temperature, working the alpha-beta titanium alloy at the second temperature, working the alpha-beta titanium alloy at the third temperature, and working the alpha-beta titanium alloy at one or more progressively lower fourth working temperatures comprises a plurality of open die press forging steps, the method further comprising reheating the alpha-beta titanium alloy intermediate two successive press forging steps.

According to another aspect of the present disclosure, a non-limiting embodiment of a method of refining alpha-phase grain size in an alpha-beta titanium alloy comprises forging an alpha-beta titanium alloy at a first forging temperature within a first forging temperature range. Forging the alpha-beta titanium alloy at the first forging temperature comprises at least one pass of both upset forging and draw forging. The first forging temperature range comprises a temperature range spanning 300° F. below the beta transus temperature of the alpha-beta titanium alloy up to a temperature 30° F. less than the beta transus temperature of the alpha-beta titanium alloy. After forging the alpha-beta titanium alloy at the first forging temperature, the alpha-beta titanium alloy is slow cooled from the first forging temperature.

The alpha-beta titanium alloy is forged at a second forging temperature within a second forging temperature range. Forging the alpha-beta titanium alloy at the second forging temperature comprises at least one pass of both upset forging and draw forging. The second forging temperature range is 600 F below the beta transus temperature of the alpha-beta titanium alloy up to 350° F. below the beta transus temperature of the alpha-beta titanium alloy, and the second forging temperature is lower than the first forging temperature.

The alpha-beta titanium alloy is forged at a third forging temperature within a third forging temperature range. Forging the alpha-beta titanium alloy at the third forging temperature comprises radial forging. The third forging temperature range is 1000° F. and 1400° F., and the final forging temperature is lower than the second forging temperature.

In a non-limiting embodiment, after forging the alpha-beta titanium alloy at the second forging temperature, and prior to forging the alpha-beta titanium alloy at the third forging temperature, the alpha-beta titanium alloy may be annealed.

In a non-limiting embodiment, after forging the alpha-beta titanium alloy at the second forging temperature, and prior to forging the alpha-beta titanium alloy at the third forging temperature, the alpha-beta titanium alloy is forged at one or more progressively lower fourth forging temperatures. The one or more progressively lower fourth forging temperatures are lower than the second forging temperature. Each of the one or more progressively lower fourth forging temperatures is within one of the second temperature range and the third temperature range. Each of the progressively lower fourth working temperatures is lower than the immediately preceding fourth working temperature.

According to another aspect of the present disclosure, a non-limiting embodiment of a method of refining alpha-phase grain size in an alpha-beta titanium alloy comprises forging an alpha-beta titanium alloy comprising a globularized alpha-phase particle microstructure at an initial forging temperature within a initial forging temperature range. Forging the alpha-beta titanium alloy at the initial forging temperature comprises at least one pass of both upset forging and draw forging. The initial forging temperature range is 500° F. below the beta transus temperature of the alpha-beta titanium alloy to 350° F. below the beta transus temperature of the alpha-beta titanium alloy.

The workpiece is forged at a final forging temperature within a final forging temperature range. Forging the workpiece at the final forging temperature comprises radial forging. The final forging temperature range is 1000° F. to 1400° F. The final forging temperature is lower than the initial forging temperature.

BRIEF DESCRIPTION OF THE DRAWINGS

The features and advantages of articles and methods described herein may be better understood by reference to the accompanying drawings in which.

Figure 1:
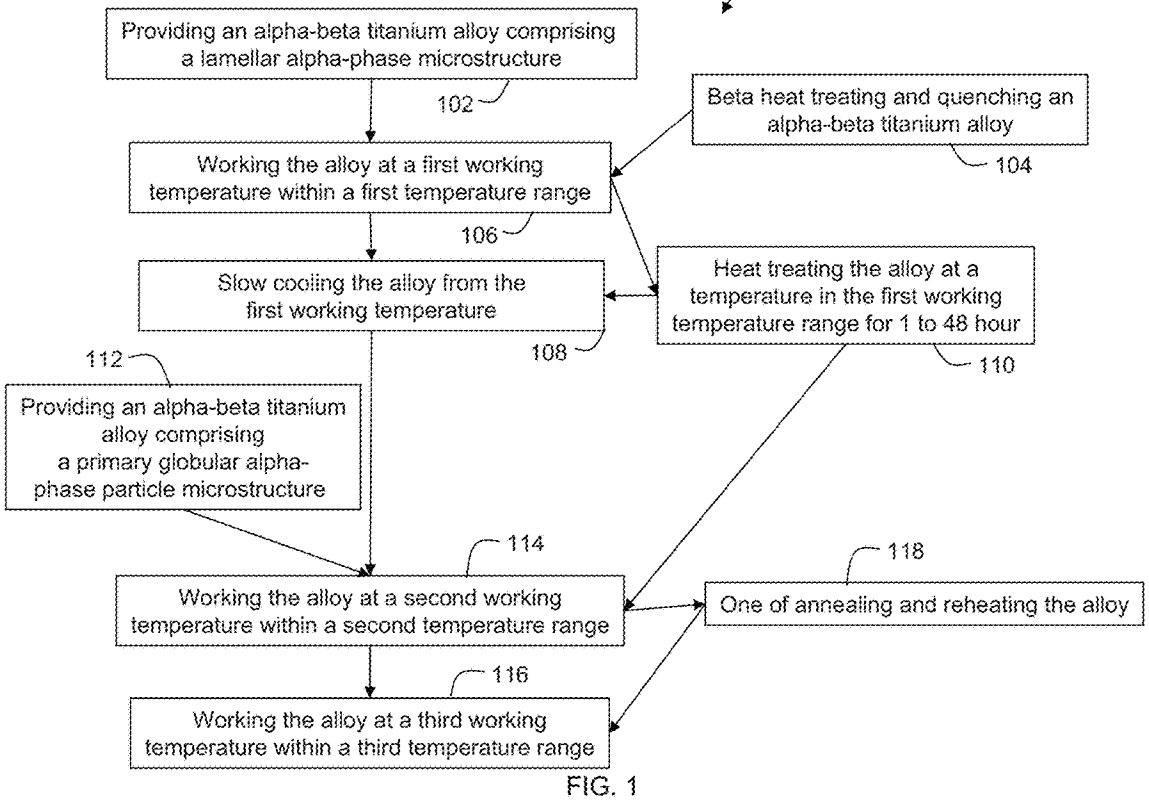
FIG. 1 is a flow diagram of a non-limiting embodiment of a method of refining alpha-phase grain size in an alpha-beta titanium alloy according to the present disclosure.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

It is to be understood that certain descriptions of the embodiments described herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

All percentages and ratios are calculated based on the total weight of the alloy composition, unless otherwise indicated.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

Figure 2:
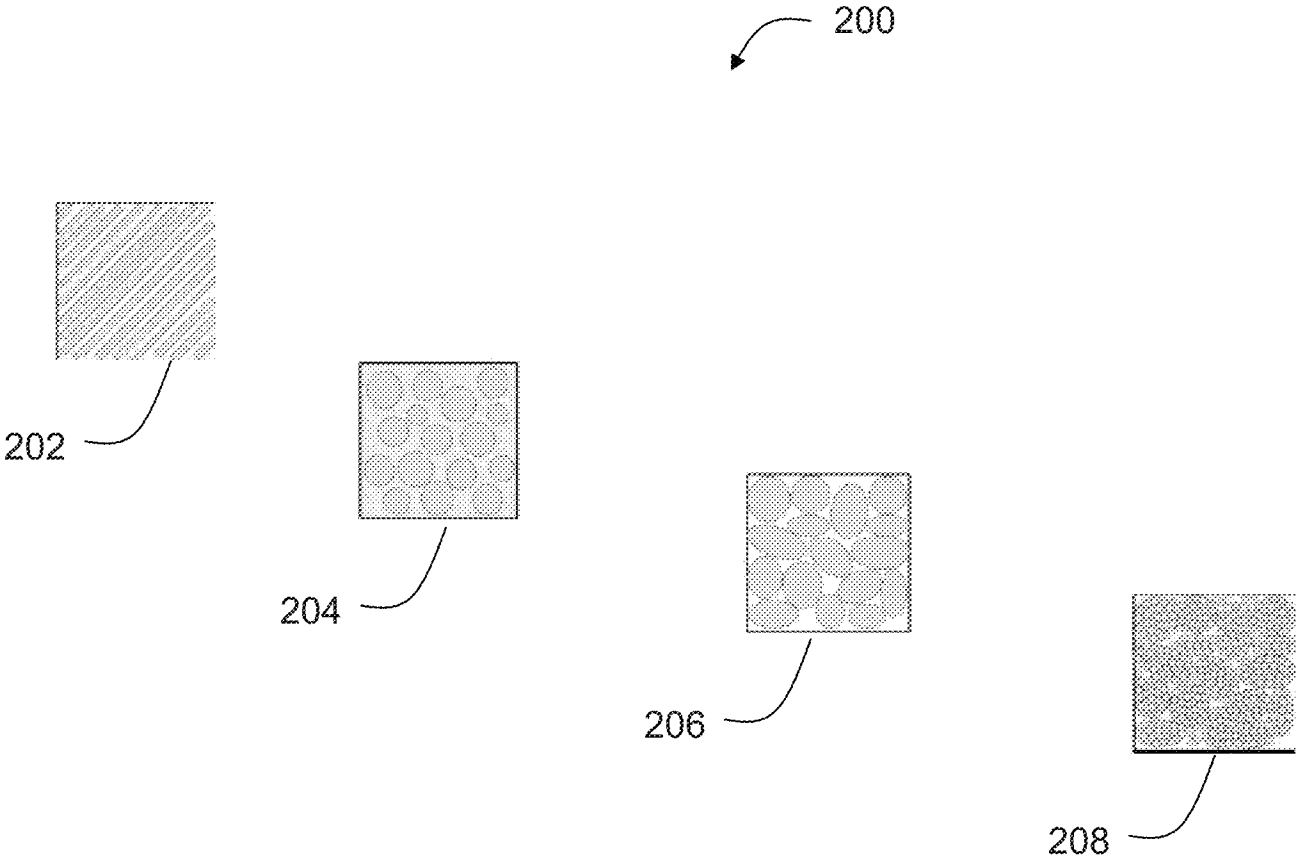
FIG. 2 is a schematic illustration of the microstructure of alpha-beta titanium alloys after processing steps according to a non-limiting embodiment of the method of the present disclosure.

According to an aspect of this disclosure, FIG. 1 is a flow chart illustrating several non-limiting embodiments of a method 100 of refining alpha-phase grain size in an alpha-beta titanium alloy according to the present disclosure. FIG. 2 is a schematic illustration of a microstructure 200 that results from processing steps according to the present disclosure. In a non-limiting embodiment according to the present disclosure, a method 100 of refining alpha-phase grain size in an alpha-beta titanium alloy comprises providing 102 an alpha-beta titanium alloy comprising a lamellar alpha-phase microstructure 202. A person having ordinary skill in the arts knows that a lamellar alpha-phase microstructure 202 is obtained by beta heat treating an alpha-beta titanium alloy followed by quenching. In a non-limiting embodiment, an alpha-beta titanium alloy is beta heat treated and quenched 104 in order to provide a lamellar alpha-phase microstructure 202. In a non limiting embodiment, beta heat treating the alloy further comprises working the alloy at the beta heat treating temperature. In yet another non-limiting embodiment, working the alloy at the beta heat treating temperature comprises one or more of roll forging, swaging, cogging, open-die forging, impression-die forging, press forging, automatic hot forging, radial forging, upset forging, draw forging, and multiaxis forging.

Still referring to FIGS. 1 and 2, a non-limiting embodiment of a method 100 for refining alpha-phase grain size in an alpha-beta titanium alloy comprises working 106 the alloy at a first working temperature within a first temperature range. It will be recognized that the alloy may be forged one or more times in the first temperature range, and may be forged at one or more temperatures in the first temperature range. In a non-limiting embodiment, when the alloy is worked more than once in the first temperature range, the alloy is first worked at a lower temperature in the first temperature range and then subsequently worked at a higher temperature in the first temperature range. In another non-limiting embodiment, when the alloy is worked more than once in the first temperature range, the alloy is first worked at a higher temperature in the first temperature range and then subsequently worked at a lower temperature in the first temperature range. The first temperature range is in the alpha-beta phase field of the alpha-beta titanium alloy. In a non-limiting embodiment, the first temperature range is a temperature range that results in a microstructure comprising primary globular alpha phase particles. The phrase "primary globular alpha-phase particles", as used herein, refers to generally equiaxed particles comprising the close-packed hexagonal alpha-phase allotrope of titanium metal that forms after working at the first working temperature according to the present disclosure, or that forms from any other thermomechanical process known now or hereafter to a person having ordinary skill in the art. In a non-limiting embodiment, the first temperature range is in the higher domain of the alpha-beta phase field. In a specific non-limiting embodiment, the first temperature range is 300° F. below the beta transus up to a temperature 30° F. below a beta transus temperature of the alloy. It will be recognized that working 104 the alloy at temperatures within the first temperature range, which may be relatively high in the alpha-beta phase field, produces a microstructure 204 comprising primary globular alpha-phase particles.

The term "working", as used herein, refers to thermomechanical working or thermomechanical processing ("TMP"). "Thermomechanical working" is defined herein as generally covering a variety of metal forming processes combining controlled thermal and deformation treatments to obtain synergistic effects, such as, for example, and without limitation, improvement in strength, without loss of toughness. This definition of thermomechanical working is consistent with the meaning ascribed in, for example, ASM Materials Engineering Dictionary, J. R. Davis, ed., ASM International (1992), p. 480. Also, as used herein, the terms "forging", "open die press forging", "upset forging", "draw forging", and "radial forging" refer to forms of thermomechanical working. The term "open die press forging", as used herein, refers to the forging of metal or metal alloy between dies, in which the material flow is not completely restricted, by mechanical or hydraulic pressure, accompanied with a single work stroke of the press for each die session. This definition of open press die forging is consistent with the meaning ascribed in, for example, ASM Materials Engineering Dictionary, J. R. Davis, ed., ASM International (1992), pp. 298 and 343. The term "radial forging", as used herein, refers to a process using two or more moving anvils or dies for producing forgings with constant or varying diameters along their length. This definition of radial forging is consistent with the meaning ascribed in, for example, ASM Materials Engineering Dictionary, J. R. Davis, ed., ASM International (1992), p. 354. The term "upset forging", as used herein, refers to open-die forging a workpiece such that a length of the workpiece generally decreases and the cross-section of the workpiece generally increases. The term "draw forging", as used herein, refers to open-die forging a workpiece such that a length of the workpiece generally increases and the cross-section of the workpiece generally decreases. Those having ordinary skill in the metallurgical arts will readily understand the meanings of these several terms.

In a non-limiting embodiment of the methods according to the present disclosure the alpha-beta titanium alloy is selected from a Ti-6Al-4V alloy (UNS R56400), a Ti-6Al-4V ELI alloy (UNS R56401), a Ti-6Al-2Sn-4Zr-2Mo alloy (UNS R54620), a Ti-6Al-2Sn-4Zr-6Mo alloy (UNS R56260), and a Ti-4Al-2.5V-1.5Fe alloy (UNS 54250; ATI 425® alloy). In another non-limiting embodiment of the methods according to the present disclosure the alpha-beta titanium alloy is selected from Ti-6Al-4V alloy (UNS R56400) and Ti-6Al-4V ELI alloy (UNS R56401). In a specific non-limiting embodiment of the methods according to the present disclosure the alpha-beta titanium alloy is a Ti-4Al-2.5V-1.5Fe alloy (UNS 54250).

After working 106 the alloy at the first working temperature in the first temperature range, the alloy is slow cooled 108 from the first working temperature. By slow cooling the alloy from the first working temperature, the microstructure comprising primary globular alpha-phase is maintained and is not transformed into secondary lamellar alpha-phases, as occurs after fast cooling, or quenching, as disclosed in the EP '429 patent, discussed above. It is believed that a microstructure formed of globularized alpha-phase particles exhibits better ductility at lower forging temperatures than a microstructure comprising lamellar alpha-phase.

The terms "slow cooled" and "slow cooling", as used herein, refer to cooling the workpiece at a cooling rate of no greater than 5° F. per minute. In a non-limiting embodiment, slow cooling 108 comprises furnace cooling at a preprogrammed ramp-down rate of no greater than 5° F. per minute. It will be recognized that slow cooling according to the present disclosure may comprise slow cooling to ambient temperature or slow cooling to a lower working temperature at which the alloy will be further worked. In a non-limiting embodiment, slow cooling comprises transferring the alpha-beta titanium alloy from a furnace chamber at the first working temperature to a furnace chamber at a second working temperature. In a specific non-limiting embodiment, when the diameter of the workpiece is greater than to or equal 12 inches, and it is ensured that the workpiece has sufficient thermal inertia, slow cooling comprises transferring the alpha-beta titanium alloy from a furnace chamber at the first working temperature to a furnace chamber at a second working temperature. The second working temperature is described hereinbelow.

Before slow cooling 108, in a non-limiting embodiment, the alloy may be heat treated 110 at a heat treating temperature in the first temperature range. In a specific non-limiting embodiment of heat treating 110, the heat treating temperature range spans a temperature range from 1600° F. up to a temperature that is 30° F. less than a beta transus temperature of the alloy. In a non-limiting embodiment, heat treating 110 comprises heating to the heat treating temperature, and holding the workpiece at the heat treating temperature. In a non-limiting embodiment of heat treating 110, the workpiece is held at the heat treating temperature for a heat treating time of 1 hour to 48 hours. It is believed that heat treating helps to complete the globularization of the primary alpha-phase particles. In a non-limiting embodiment, after slow cooling 108 or heat treating 110 the microstructure of an alpha-beta titanium alloy comprises at least 60 percent by volume alpha-phase fraction, wherein the alpha-phase comprises or consists of globular primary alpha-phase particles.

It is recognized that a microstructure of an alpha-beta titanium alloy including a microstructure comprising globular primary alpha-phase particles may be formed by a different process than described above. In such a case, a non-limiting embodiment of the present disclosure comprises providing 112 an alpha-beta titanium alloy comprising a microstructure comprising or consisting of globular primary alpha-phase particles.

In non-limiting embodiments, after working 106 the alloy at the first working temperature and slow cooling 108 the alloy, or after heat treating 110 and slow cooling 108 the alloy, the alloy is worked 114 one or more times at a second working temperature within a second temperature range, and may be forged at one or more temperatures in the second temperature range. In a non-limiting embodiment, when the alloy is worked more than once in the second temperature range, the alloy is first worked at a lower temperature in the second temperature range and then subsequently worked at a higher temperature in the second temperature range. It is believed that when the workpiece is first worked at a lower temperature in the second temperature range and then subsequently worked at a higher temperature in the second temperature range, recrystallization is enhanced. In another non-limiting embodiment, when the alloy is worked more than once in the first temperature range, the alloy is first worked at a higher temperature in the first temperature range and then subsequently worked at a lower temperature in the first temperature range. The second working temperature is lower than the first working temperature, and the second temperature range is in the alpha-beta phase field of the alpha-beta titanium alloy. In a specific non-limiting embodiment the second temperature range is 600° F. to 350° F. below the beta transus. and may be forged at one or more temperatures in the first temperature range.

In a non-limiting embodiment, after working 114 the alloy at the second working temperature, the alloy is cooled from the second working temperature. After working 114 at the second working temperature, the alloy can be cooled at any cooling rate, including, but not limited to, cooling rates that are provided by any of furnace cooling, air cooling, and liquid quenching, as know to a person having ordinary skill in the art. It will be recognized that cooling may comprise cooling to ambient temperature or to the next working temperature at which the workpiece will be further worked, such as one of the third working temperature or a progressively lower fourth working temperature, as described below. It will also be recognized that, in a non-limiting embodiment, if a desired degree of grain refinement is achieved after the alloy is worked at the second working temperature, further working of the alloy is not required.

In non-limiting embodiments, after working 114 the alloy at the second working temperature, the alloy is worked 116 at a third working temperature, or worked one or more times at one or more third working temperatures. In a non-limiting embodiment, a third working temperature may be a final working temperature within a third working temperature range. The third working temperature is lower than the second working temperature, and the third temperature range is in the alpha-beta phase field of the alpha-beta titanium alloy. In a specific non-limiting embodiment, the third temperature range is 1000° F. to 1400° F. In a non-limiting embodiment, after working 116 the alloy at the third working temperature, a desired refined alpha-phase grain size is attained. After working 116 at the third working temperature, the alloy can be cooled at any cooling rate, including, but not limited to, cooling rates that are provided by any of furnace cooling, air cooling, and liquid quenching, as know to a person having ordinary skill in the art.

Still referring to FIGS. 1 and 2, while not being held to any particular theory, it is believed that by working 106 an alpha-beta titanium alloy at a relatively high temperature in the alpha-beta phase field, and possibly heat treating 110, followed by slow cooling 108, the microstructure is transformed from one comprising primarily of an alpha-phase lamellar microstructure 202 to a globularized alpha-phase particle microstructure 204. It will be recognized the certain amounts of beta-phase titanium, i.e. the body-centered cubic phase allotrope of titanium, may be present between the alpha-phase lamella or between the primary alpha phase particles. The amount of beta-phase titanium present in the alpha-beta titanium alloy after any working and cooling steps is primarily dependent on the concentration of beta-phase stabilizing elements present in a specific alpha-beta titanium alloy, which is well understood by a person having ordinary skill in the art. It is noted that the lamellar alpha-phase microstructure 202, which is subsequently transformed into primary globularized alpha-particles 204, can be produced by beta heat treating and quenching 104 the alloy prior to working the alloy at the first working temperature and quenching, as described hereinabove.

The globularized alpha-phase microstructure 204 serves as a starting stock for subsequent lower-temperature working. Globularized alpha-phase microstructure 204 has generally better ductility than a lamellar alpha-phase microstructure 202. While the strain required to recrystallize and refine globular alpha-phase particles may be greater than the strain needed to globularize lamellar alpha-phase microstructures, the alpha-phase globular particle microstructure 204 also exhibits far better ductility, especially when working at low temperatures. In a non-limiting embodiment herein in which working comprises forging, the better ductility is observed even at moderate forging die speeds. In other words, the gains in forging strain allowed by better ductility at moderate die speeds of the globularized alpha-phase microstructure 204 exceed the strain requirements for refining the alpha-phase grain size, e.g., low die speeds, and may result in better yields and lower press times.

While still not being held to any particular theory, it is further believed that because the globularized alpha-phase particle microstructure 204 has higher ductility than a lamellar alpha-phase microstructure 202, it is possible to refine the alpha-phase grain size using sequences of lower temperature working according to the present disclosure (steps 114 and 116, for example) to trigger waves of controlled recrystallization and grain growth within the globular alpha-phase particles 204,206. In the end, in alpha-beta titanium alloys processed according to non-limiting embodiments herein, the primary alpha-phase particles produced in the globularization achieved by the first working 106 and cooling steps 108 are not fine or ultrafine themselves, but rather comprise or consist of a large number of recrystallized fine to ultrafine alpha-phase grains 208.

Still referring to FIG. 1, a non-limiting embodiment of refining alpha-phase grains according to the present disclosure comprises an optional annealing or reheating 118 after working 114 the alloy at the second working temperature, and prior to working 116 the alloy at the third working temperature. Optional annealing 118 comprises heating the alloy to an annealing temperature in an annealing temperature range spanning 500° F. below the beta transus temperature of the alpha-beta titanium alloy up to 250° F. below the beta transus temperature of the alpha-beta titanium alloy for an annealing time of 30 minutes to 12 hours. It will be recognized shorter times can be applied when choosing higher temperatures, and longer annealing times can be applied when choosing lower temperatures. It is believed that annealing increases recrystallization, albeit at the cost of some grain coarsening, and which ultimately assists in the alpha-phase grain refinement.

In non-limiting embodiments, the alloy may be reheated to a working temperature before any step of working the alloy. In an embodiment, any of the working steps may comprise multiple working steps, such as for example, multiple draw forging steps, multiple upset forging steps, any combination of upset forging and draw forging, any combination of multiple upset forging and multiple draw forging, and radial forging. In any method of refining alpha-phase grain size according to the present disclosure, the alloy may be reheated to a working temperature intermediate any of the working or forging steps at that working temperature. In a non-limiting embodiment, reheating to a working temperature comprises heating the alloy to the desired working temperature and holding the alloy at temperature for 30 minutes to 6 hours. It will be recognized that when the workpiece is taken out of the furnace for an extended time, such as 30 minutes or more, for intermediate conditioning, such as cutting the ends, for example, the reheating can be extended to more than 6 hours, such as to 12 hours, or however long a skilled practitioner knows that the entire workpiece is reheated to the desired working temperature. In a non-limiting embodiment, reheating to a working temperature comprises heating the alloy to the desired working temperature and holding the alloy at temperature for 30 minutes to 12 hours.

After working 114 at the second working temperature, the alloy is worked 116 at the third working temperature, which may be a final working step, as described hereinabove. In a non-limiting embodiment, working 116 at the third temperature comprises radial forging. When previous working steps comprise open-end press forging, open end press forging imparts more strain to a central region of the workpiece, as disclosed in co-pending U.S. application Ser. No. 13/792,285, which is incorporated by reference herein in its entirety. It is noted that radial forging provides better final size control, and imparts more strain to the surface region of an alloy workpiece, so that the strain in the surface region of the forged workpiece may be comparable to the strain in the central region of the forged workpiece.

According to another aspect of the present disclosure, non-limiting embodiments of a method of refining alpha-phase grain size in an alpha-beta titanium alloy comprises forging an alpha-beta titanium alloy at a first forging temperature, or forging more than once at one or more forging temperatures within a first forging temperature range. Forging the alloy at the first forging temperature, or at one or more first forging temperatures comprises at least one pass of both upset forging and draw forging. The first forging temperature range comprises a temperature range spanning 300° F. below the beta transus up to a temperature 30° F. below a beta transus temperature of the alloy. After forging the alloy at the first forging temperature and possibly annealing it, the alloy is slow cooled from the first forging temperature.

The alloy is forged once or more than once at a second forging temperature, or at one or more second forging temperatures, within a second forging temperature range. Forging the alloy at the second forging temperature comprises at least one pass of both upset forging and draw forging. The second forging temperature range is 600° F. to 350° F. below the beta transus.

The alloy is forged once or more than once at a third forging temperature, or at one or more third forging temperatures within a third forging temperature range. In a non-limiting embodiment, the third forging operation is a final forging operation within a third forging temperature range. In a non-limiting embodiment, forging the alloy at the third forging temperature comprises radial forging. The third forging temperature range comprises a temperature range spanning 1000° F. and 1400° F., and the third forging temperature is lower than the second forging temperature.

In a non-limiting embodiment, after forging the alloy at the second forging temperature, and prior to forging the alloy at the third forging temperature, the alloy is forged at one or more progressively lower fourth forging temperatures. The one or more progressively lower fourth forging temperatures are lower than the second forging temperature. Each of the fourth working temperatures is lower than the immediately preceding fourth working temperature, if any.

In a non-limiting embodiment, the high alpha-beta field forging operations, i.e., forging at the first forging temperature, results in a range of primary globularized alpha-phase particles sizes from 15 μm to 40 μm. The second forging process starts with multiple forge, reheats and anneal operations, such as one to three upsets and draws, between 500° F. to 350° F. below the beta transus, followed by multiple forge, reheats and anneal operations, such as one to three upsets and draws, between 550° F. to 400° F. below the beta transus. In a non-limiting embodiment, the workpiece may be reheated intermediate any forging step. In a non-limiting embodiment, at any reheat step in the second forging process, the alloy may be annealed between 500° F. and 250° F. below the beta transus for an annealing time of 30 minutes to 12 hours, shorter times being applied when choosing higher temperatures and longer times being applied when choosing lower temperatures, as would be recognized by a skilled practitioner. In a non-limiting embodiment, the alloy may be forged down in size at temperatures of between 600° F. to 450° F. below the beta transus temperature of the alpha-beta titanium alloy. Vee dies for forging may be used at this point, along with lubricating compounds, such as, for example, boron nitride or graphite sheets. In a non-limiting embodiment, the alloy is radial forged either in one series of 2 to 6 reductions performed at 1100° F. to 1400° F., or in multiple series of 2 to 6 reductions and reheats with temperatures starting at no more than 1400° F. and decreasing for each new reheat down to no less than 1000° F.

According to another aspect of the present disclosure, a non-limiting embodiment of a method of refining alpha-phase grain size in an alpha-beta titanium alloy comprises forging an alpha-beta titanium alloy comprising a globularized alpha-phase particle microstructure at an initial forging temperature within a initial forging temperature range. Forging the alloy at the initial forging temperature comprises at least one pass of both upset forging and draw forging. The initial forging temperature range is 500° F. to 350° F. below the beta transus temperature of the alpha-beta titanium alloy.

The alloy is forged at a final forging temperature within a final forging temperature range. Forging the workpiece at the final forging temperature comprises radial forging. The final forging temperature range is 600° F. to 450° F. below the beta transus. The final forging temperature is lower than each of the one or more progressively lower forging temperatures.

The examples that follow are intended to further describe certain non-limiting embodiments, without restricting the scope of the present invention. Persons having ordinary skill in the art will appreciate that variations of the following examples are possible within the scope of the invention, which is defined solely by the claims.

Example 1

A workpiece comprising Ti-6Al-4V alloy was heated and forged in the first working temperature range according to usual methods to those familiar in the art of forming a substantially globularized primary alpha microstructure. The workpiece was then heated to a temperature of 1800° F., which is in the first forging temperature range, for 18 hours (as per box 110 in FIG. 1). Then it was slow cooled in the furnace at −100° F. per hour or between 1.5 and 2° F. per minute down to 1200° F. and then air cooled to ambient temperature. Backscattered electron (BSE) micrographs of the microstructure of the forged and slow cooled alloy are presented in FIGS. 3 and 4.

Figure 3:
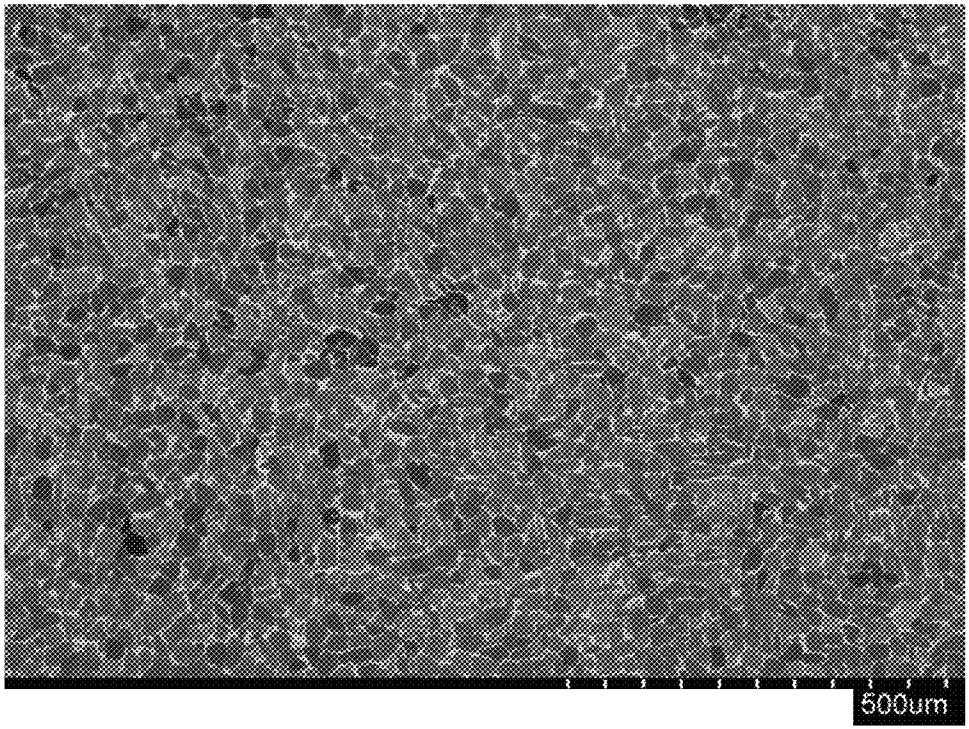
FIG. 3 is a backscattered electron (BSE) micrograph of the microstructure of a forged and slow cooled alpha-beta phase titanium alloy workpiece according to a non-limiting embodiment of the method of the present disclosure.
Figure 4:
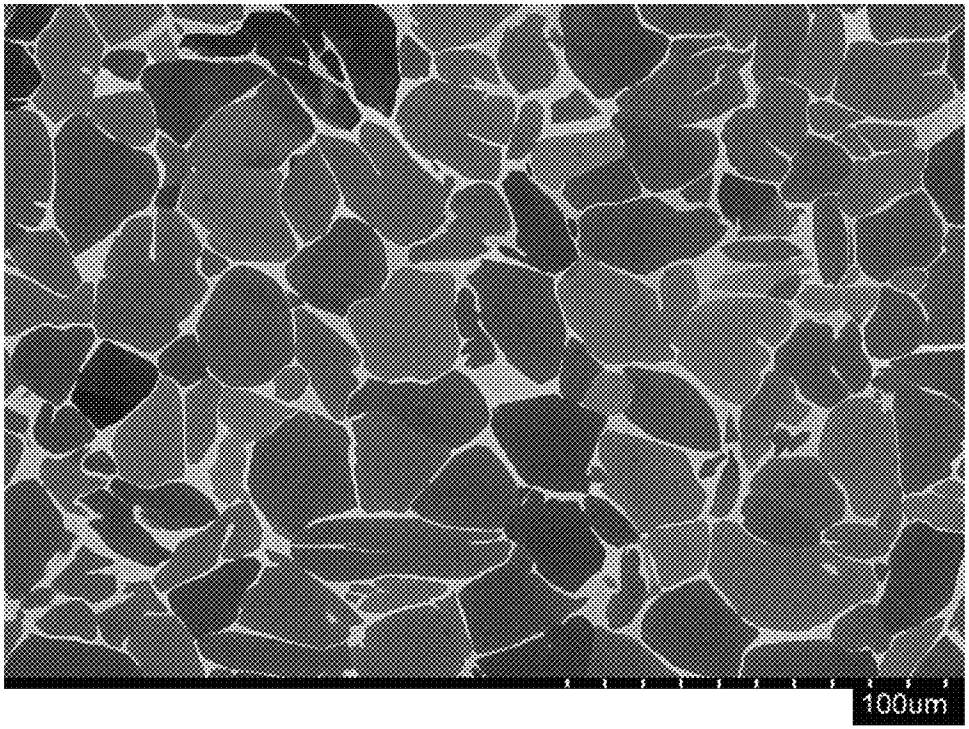
FIG. 4 is a BSE micrograph of the microstructure of a forged and slow cooled alpha-beta phase titanium alloy according to a non-limiting embodiment of the method of the present disclosure.
Figure 5:
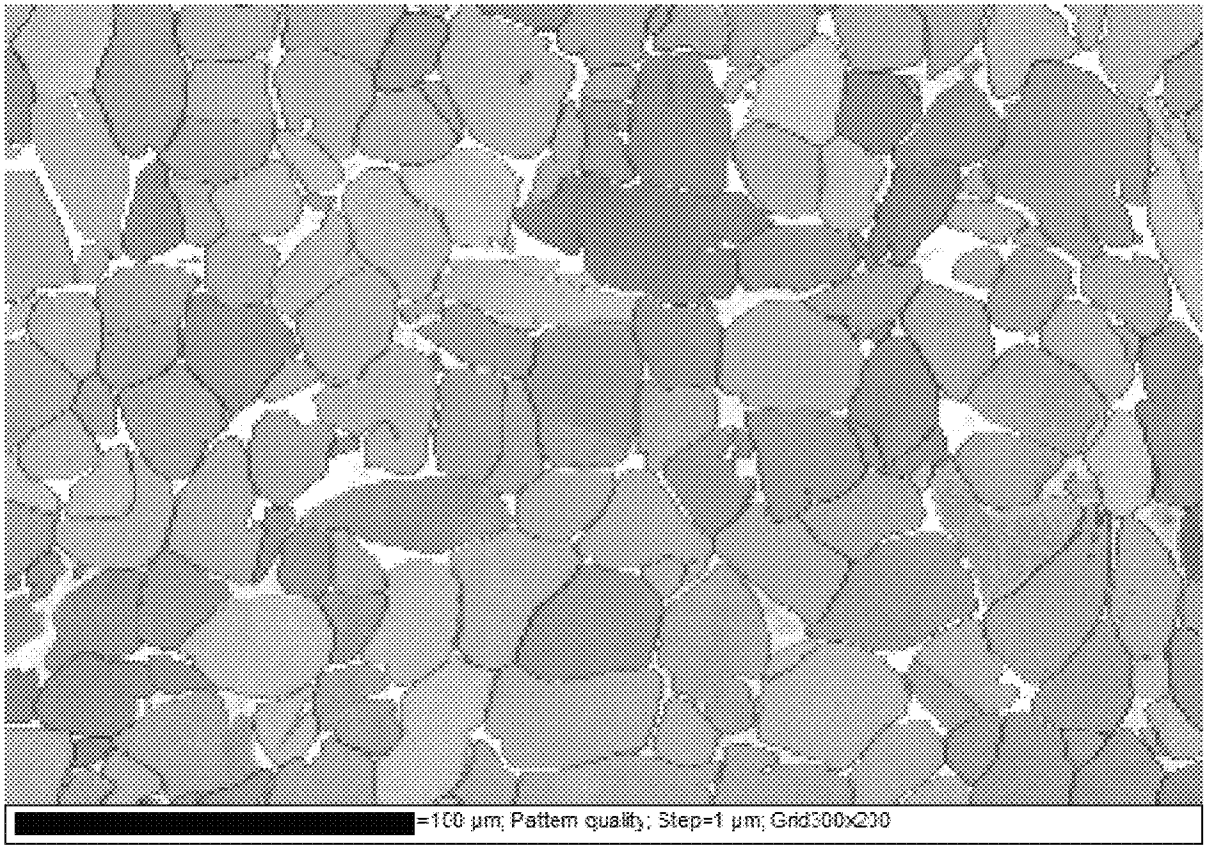
FIG. 5 is an electron backscattered diffraction (EBSD) micrograph of a forged and slow cooled alpha-beta phase titanium alloy according to a non-limiting embodiment of the method of the present disclosure.

In the BSE micrographs of FIGS. 3 and 4, it is observed that after forging at a relatively high temperature in the alpha-beta phase field, followed by slow cooling, the microstructure comprises primary globularized alpha-phase particles interspersed with beta-phase. In the micrographs, levels of grey shading are related to the average atomic number, thereby indicating chemical composition variables, and also vary locally based on crystal orientation. The light-colored areas in the micrographs are beta phase that is rich in vanadium. Due to the relatively higher atomic number of vanadium, the beta phase appears as a lighter shade of grey. The darker-colored areas are globularized alpha phase. FIG. 5 is an electron backscattered diffraction (EBSD) micrograph of the same alloy sample showing the diffraction pattern quality. Again, the light-colored areas are beta-phase as it exhibited sharper diffraction patterns in these experiments, and the dark-colored areas are alpha-phase as it exhibited less sharp diffraction patterns. It was observed that forging an alpha-beta titanium alloy at a relatively high temperature in the alpha-beta phase field, followed by slow cooling, results in a microstructure that comprises primary globularized alpha-phase particles interspersed with beta-phase.

Example 2

Figure 6B:
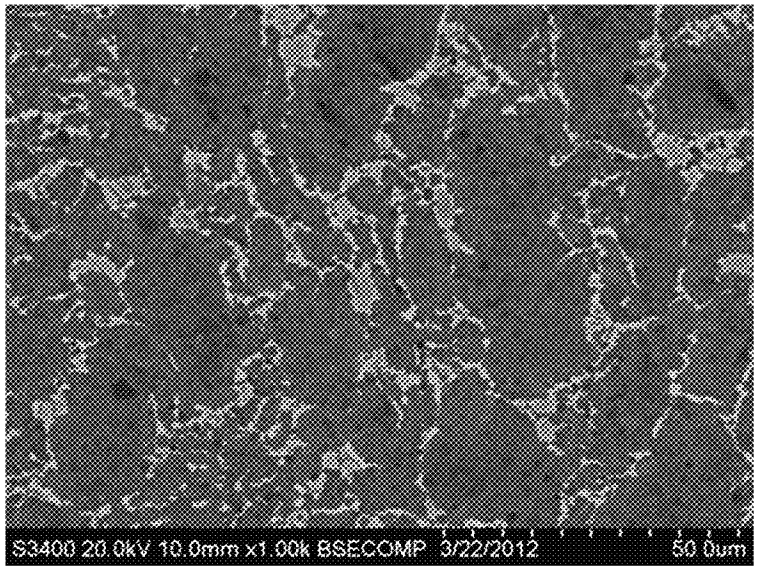
FIG. 6B is a BSE micrograph of the microstructure of a forged and slow cooled alpha-beta phase titanium alloy according to the non-limiting embodiment of FIG. 6A that was further forged and annealed according to a non-limiting embodiment of the method of the present disclosure.
Figure 6A:
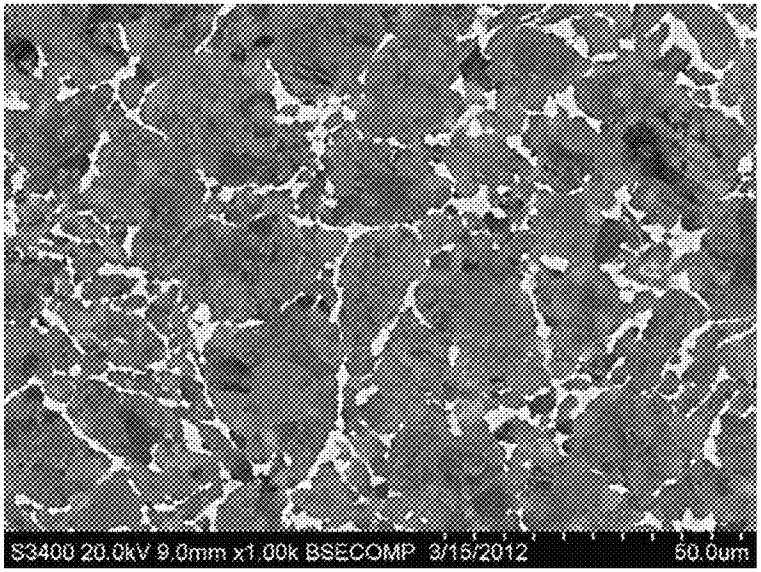
FIG. 6A is a BSE micrograph of the microstructure of a forged and slow cooled alpha-beta phase titanium alloy according to a non-limiting embodiment of the present disclosure.

Two workpieces in the shape of 4" cubes of Ti-6-4 material produced using similar method as for Example 1 was heated to 1300° F. and forged through two cycles (6 hits to 3.5" height) of rather rapid, open-die multi-axis forging operated at strain rates of about 0.1 to 1/s to reach a center strain of at least 3. Fifteen second holds were made between hits to allow for some dissipation of adiabatic heating. The workpieces were subsequently annealed at 1450° F. for almost 1 hour and then moved to a furnace at 1300° F. to be soaked for about 20 minutes. The first workpiece was finally air cooled. The second workpiece was forged again through two cycles (6 hits to 3.5" height) of rather rapid, open-die multi-axis forging operated at strain rates of about 0.1 to 1/s to impart a center strain of at least 3, viz. a total strain of 6. Fifteen second holds were made as well between hits to allow for some dissipation of adiabatic heating. FIGS. 6A and 6B are BSE micrographs of the first and second samples, respectively, after they underwent processing. Again, grey shading levels are related to the average atomic number, thereby indicating chemical composition variations, and also variations locally with respect to crystal orientation. In this sample shown in FIGS. 6A and 6B, light-colored regions are beta phase, while the darker-colored regions are globular alpha-phase particles. Variation of the grey levels inside the globularized alpha-phase particle reveals crystal orientation changes, such as the presence of sub-grains and recrystallized grains.

Figure 7:
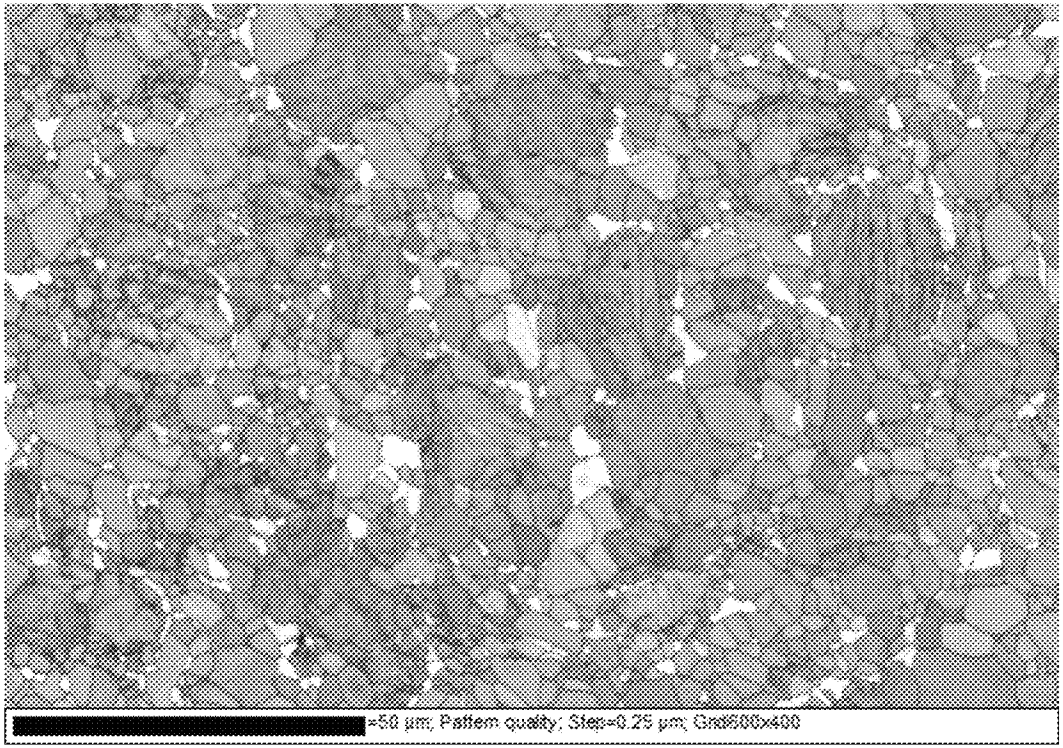
FIG. 7 is an EBSD micrograph of a forged and slow cooled alpha-beta phase titanium alloy that was further forged and annealed according to a non-limiting embodiment of the method of the present disclosure.
Figure 8:
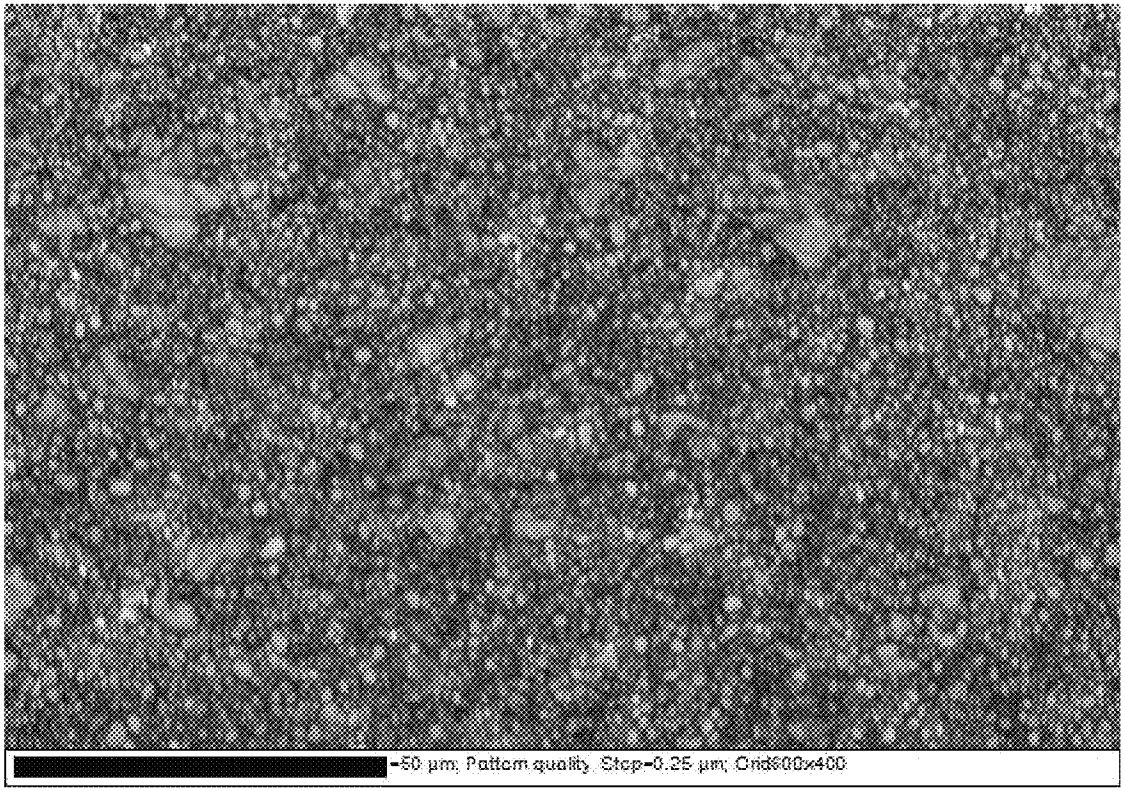
FIG. 8 is an EBSD micrograph of a forged and slow cooled alpha-beta phase titanium alloy that was further forged and annealed according to a non-limiting embodiment of the method of the present disclosure.

FIGS. 7 and 8 are EBSD micrographs of respectively the first and second samples of Example 2. The grey levels in this micrograph represent the quality of the EBSD diffraction patterns. In these EBSD micrographs, the light areas are beta-phase and the dark areas are alpha-phase. Some of these areas appear darker and shaded with substructures: these are the unrecrystallized, strained areas within the original or primary alpha particles. They are surrounded by the small, strain-free recrystallized alpha grains that nucleated and grew at the periphery of those alpha particles. The lightest small grains are recrystallized beta grains interspersed between alpha particles. It is seen in the micrographs of FIGS. 7 and 8 that by forging the globularized material like that of the sample of Example 1, the primary globularized alpha-phase particles are beginning to recrystallize into finer alpha-phase grains within the original or primary globularized particles.

Figure 9A:
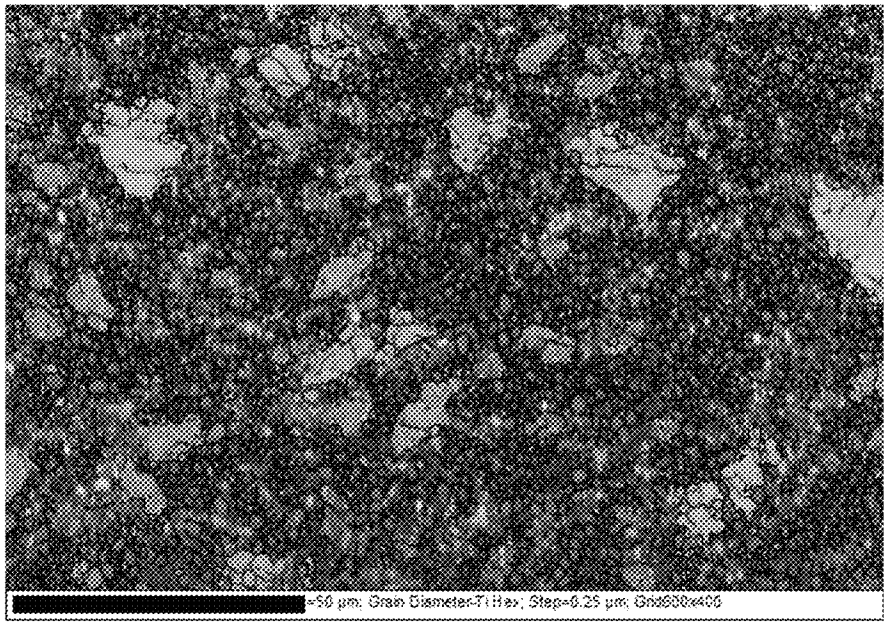
FIG. 9A is an EBSD micrograph of the sample of Example 2 that is a forged and slow cooled alpha-beta phase titanium alloy that was further forged and annealed according to a non-limiting embodiment of the method of the present disclosure.
Figure 9B:
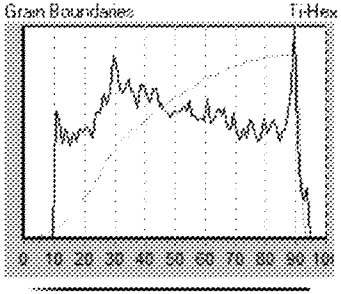
FIG. 9B is a plot showing the concentration of grains having a particular grain size in the sample of Example 2 shown in FIG. 9A.
Figure 9C:
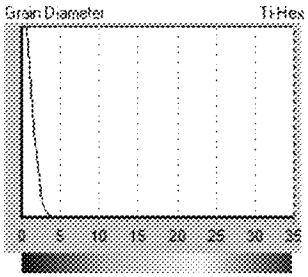
FIG. 9C is a plot of the distribution of disorientation of the alpha-phase grain boundaries of the sample of Example 2 shown in FIG. 9A.

FIG. 9A is an EBSD micrograph of the second sample of Example 2. The grey shading levels in the micrograph represent alpha grain sizes, and the grey shading levels of the grain boundaries are indicative of their disorientation. FIG. 9B is a plot of the relative amount of alpha grains in the sample having particular grain sizes, and FIG. 9C is a plot of the distribution of disorientation of the alpha-phase grain boundaries in the sample. As can be determined from FIG. 9B, a larger number of the alpha-grains achieved on forging the globularized sample of Example 1 and then annealing at 1450° F. then forging again are superfine, i.e., 1-5 μm in diameter and they are overall finer than the first sample of example 2, right after the anneal at 1450° F. that allowed some grain growth and intermediate, static progression of recrystallization.

Example 3

Two workpieces shaped as a 4" cube of ATI 425 alloy material produced using similar method as for Example 1 was heated to 1300° F. and forged through one cycle (3 hits to 3.5" height) of rather rapid, open-die multi-axis forging operated at strain rates of about 0.1 to 1/s to reach a center strain of at least 1.5. Fifteen second holds were made between hits to allow for some dissipation of adiabatic heating. The workpieces were subsequently annealed at 1400° F. for 1 hour and then moved to a furnace at 1300° F. to be soaked for 30 minutes. The first workpiece was finally air cooled. The second workpiece was forged again through one cycle (3 hits to 3.5" height) of rather rapid, open-die multi-axis forging operated at strain rates of about 0.1 to 1/s to impart a center strain of at least 1.5, viz. a total strain of 3. Fifteen second holds were made as well between hits to allow for some dissipation of adiabatic heating.

Figure 10B:
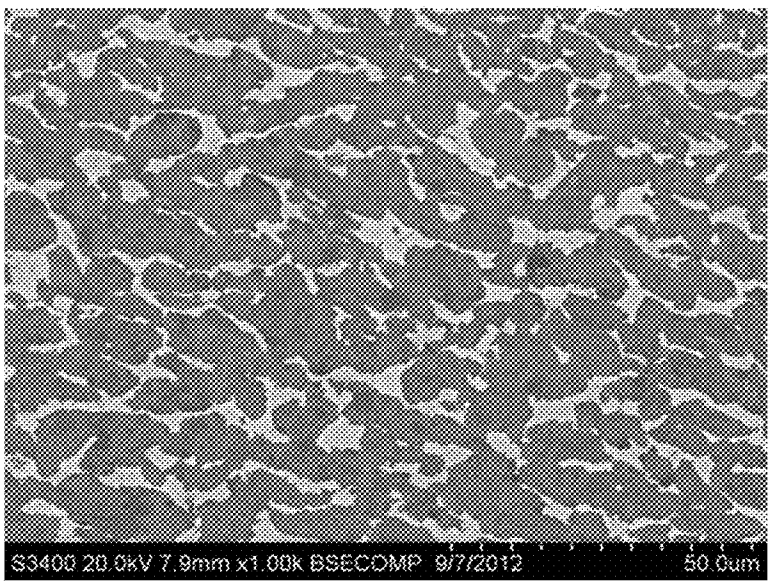
FIGS. 10A and 10B are BSE micrographs of respectively the first and second forged and annealed samples.
Figure 10A:
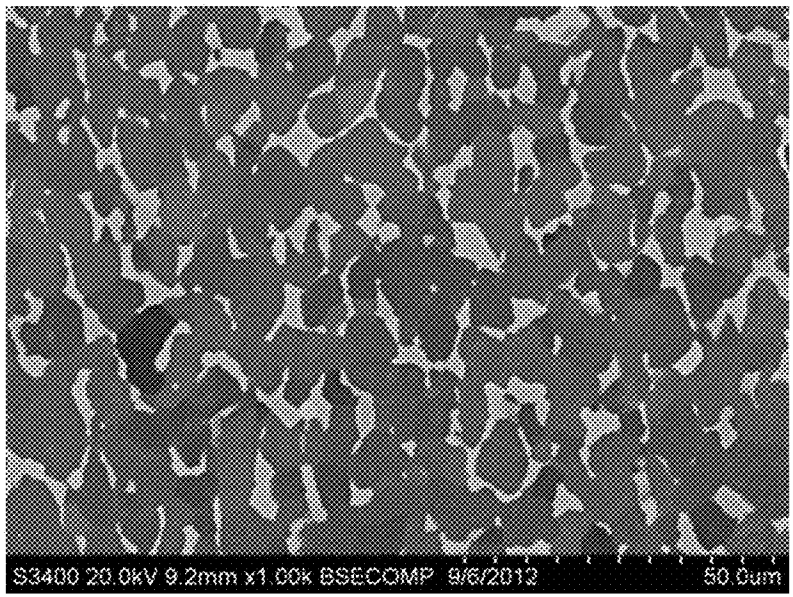

FIGS. 10A and 10B are BSE micrographs of respectively the first and second forged and annealed samples. Again, grey shading levels are related to the average atomic number, thereby indicating chemical composition variations, and also variations locally with respect to crystal orientation. In this sample shown in FIG. 10A and FIG. 10B, light-colored regions are beta phase, while the darker-colored regions are globular alpha-phase particles. Variation of the grey levels inside the globularized alpha-phase particle reveals crystal orientation changes, such as the presence of sub-grains and recrystallized grains.

Figure 11:
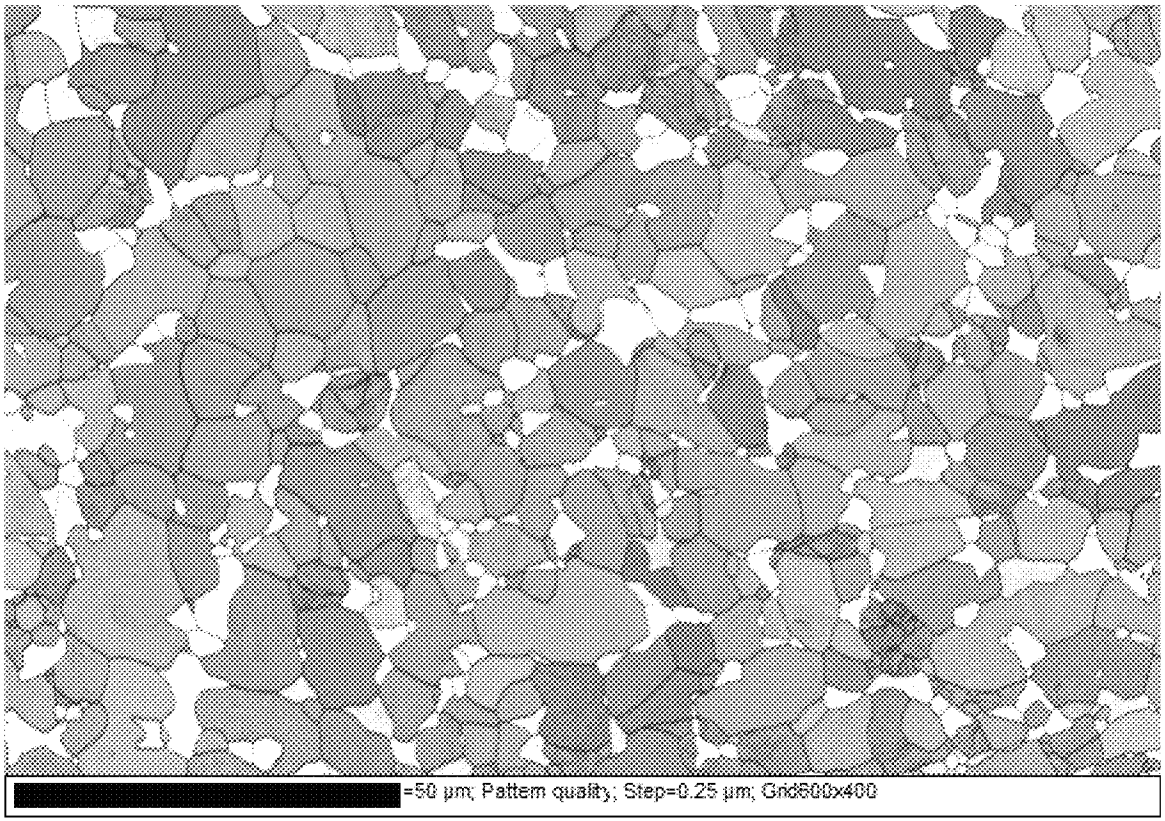
FIG. 11 is an EBSD micrographs of the first sample of Example 3.
Figure 12:
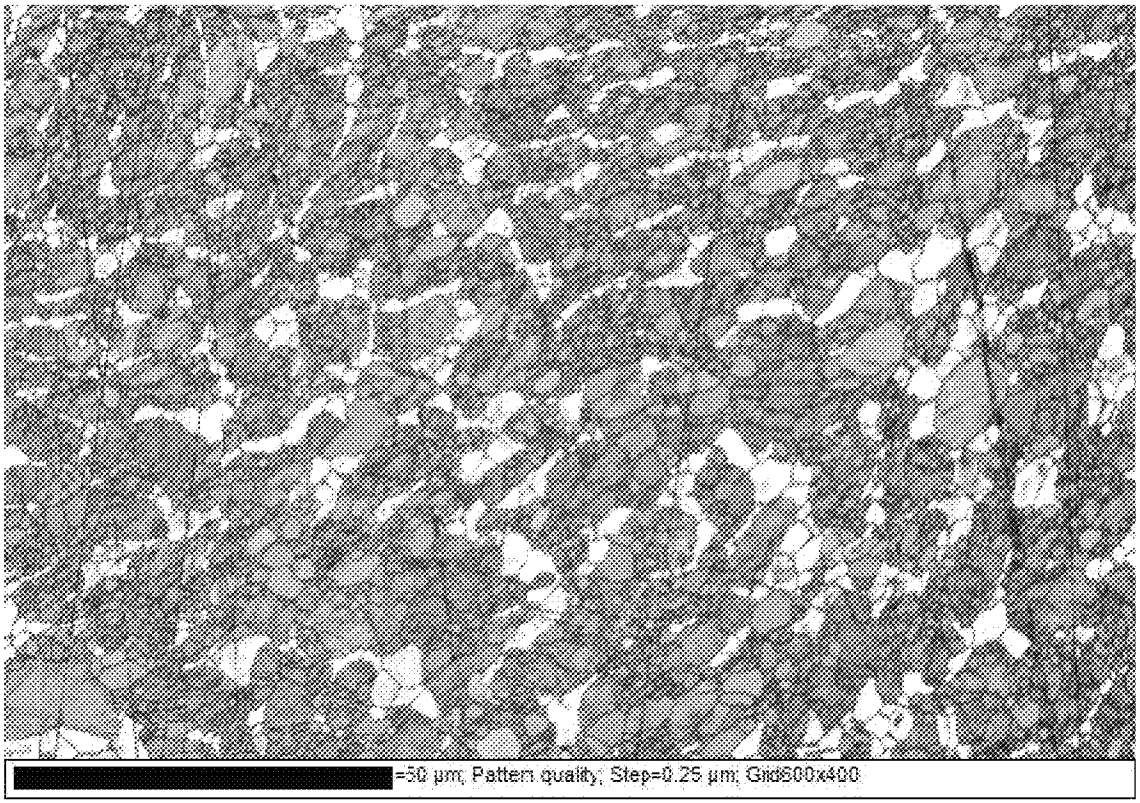
FIG. 12 is an EBSD micrographs of the second sample of Example 3.

FIGS. 11 and 12 are EBSD micrographs of respectively the first and second samples of Example 3. The grey levels in this micrograph represent the quality of the EBSD diffraction patterns. In these EBSD micrographs, the light areas are beta-phase and the dark areas are alpha-phase. Some of these areas appear darker and shaded with substructures: these are the unrecrystallized, strained areas within the original or primary alpha particles. They are surrounded by the small, strain-free recrystallized alpha grains that nucleated and grew at the periphery of those alpha particles. The lightest small grains are recrystallized beta grains interspersed between alpha particles. It is seen in the micrographs of FIGS. 11 and 12 that by forging the globularized material like that of the sample of Example 1, the primary globularized alpha-phase particles are beginning to recrystallize into finer alpha-phase grains within the original or primary globularized particles.

Figure 13A:
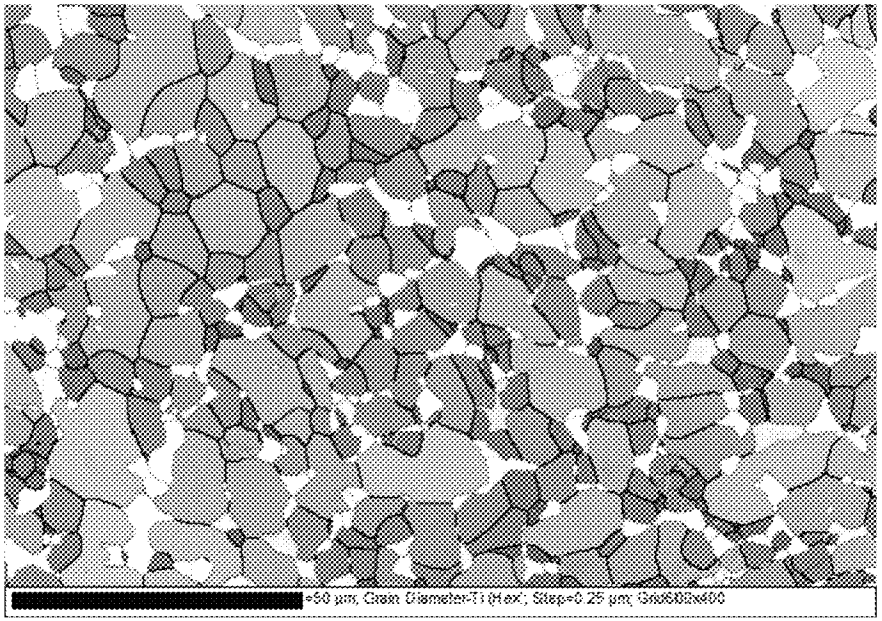
FIG. 13A is an EBSD micrograph of the second sample of Example 3.
Figure 13C:
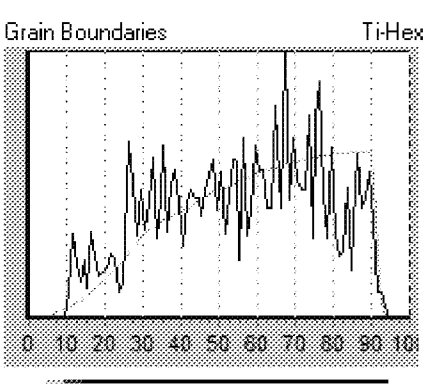
FIG. 13C is a plot of the distribution of disorientation of the alpha-phase grain boundaries in the sample of Example 3.
Figure 13B:
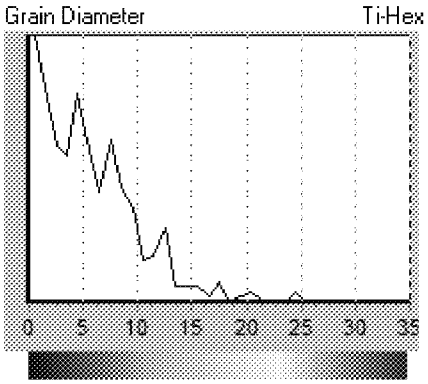
FIG. 13B is a plot of the relative amount of alpha grains in the sample of Example 3 having particular grain sizes.

FIG. 13A is an EBSD micrograph of the first sample of Example 3. The grey shading levels in the micrograph represent alpha grain sizes, and the grey shading levels of the grain boundaries are indicative of their disorientation. FIG. 13B is a plot of the relative amount of alpha grains in the sample having particular grain sizes, and FIG. 13C is a plot of the distribution of disorientation of the alpha-phase grain boundaries in the sample. As can be determined from FIG. 13B, the alpha-grains achieved on forging the globularized sample of Example 1 and then annealing at 1400° F. recrystallized and grew again during the anneal resulting in a wide alpha grain size distribution in which most grains are fine, i.e., 5-15 μm in diameter.

Figure 14A:
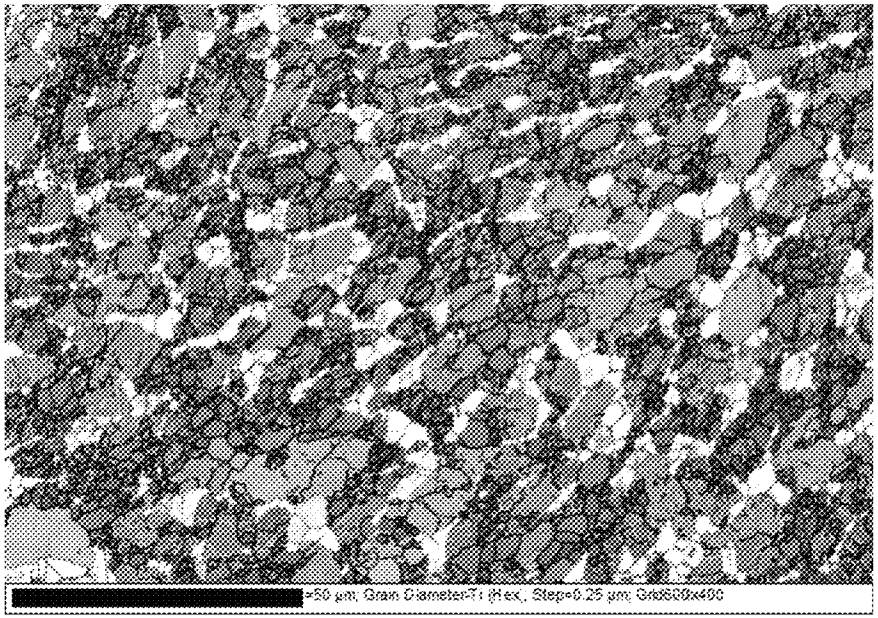
FIG. 14A is an EBSD micrograph of the second sample of Example 3.
Figure 14C:
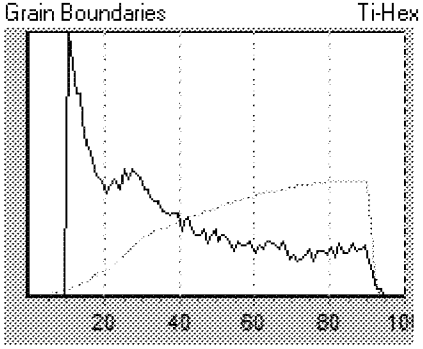
FIG. 14C is a plot of the distribution of disorientation of the alpha-phase grain boundaries in the sample of Example 3.
Figure 14B:
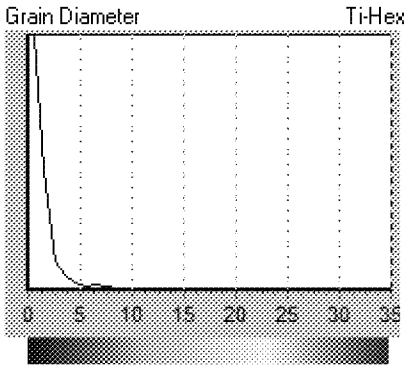
FIG. 14B is a plot of the relative amount of alpha grains in the sample of Example 3 having particular grain sizes.

FIG. 14A is an EBSD micrograph of the second sample of Example 3 The grey shading levels in the micrograph represent alpha grain sizes, and the grey shading levels of the grain boundaries are indicative of their disorientation, FIG. 14B is a plot of the relative amount of alpha grains in the sample having particular grain sizes, and FIG. 14C is a plot of the distribution of disorientation of the alpha-phase grain boundaries in the sample. As can be determined from FIG. 14B, a number of the alpha-grains achieved on forging the globularized sample of Example 1 and then annealing at 1400° F. then forging again are superfine, i.e., 1-5 μm in diameter. The coarser unrecrystallized grains are remnants of the grains that grew the most during the anneal. It shows that anneal time and temperature must be chosen carefully to be fully beneficial, i.e. allow an increase in recrystallized fraction without excessive grain growth.

Example 4

A 10" diameter workpiece of Ti-6-4 material produced using similar method as for Example 1 was further forged through four upsets and draws performed at temperatures between 1450° F. and 1300° F. decomposed as first a series of draws and reheats at 1450° F. down to 7.5" diameter, then second, two similar upset-and-draws sequences made of an about 20% upset at 1450° F. and draws back to 7.5" diameter at 1300° F., then third, draws down to 5.5" diameter at 1300° F., then fourth, two similar upset-and-draws sequences made of an about 20% upset at 1400° F. and draws back to 5.0" diameter at 1300° F., and finally draws down to 4" at 1300° F.

Figure 15:
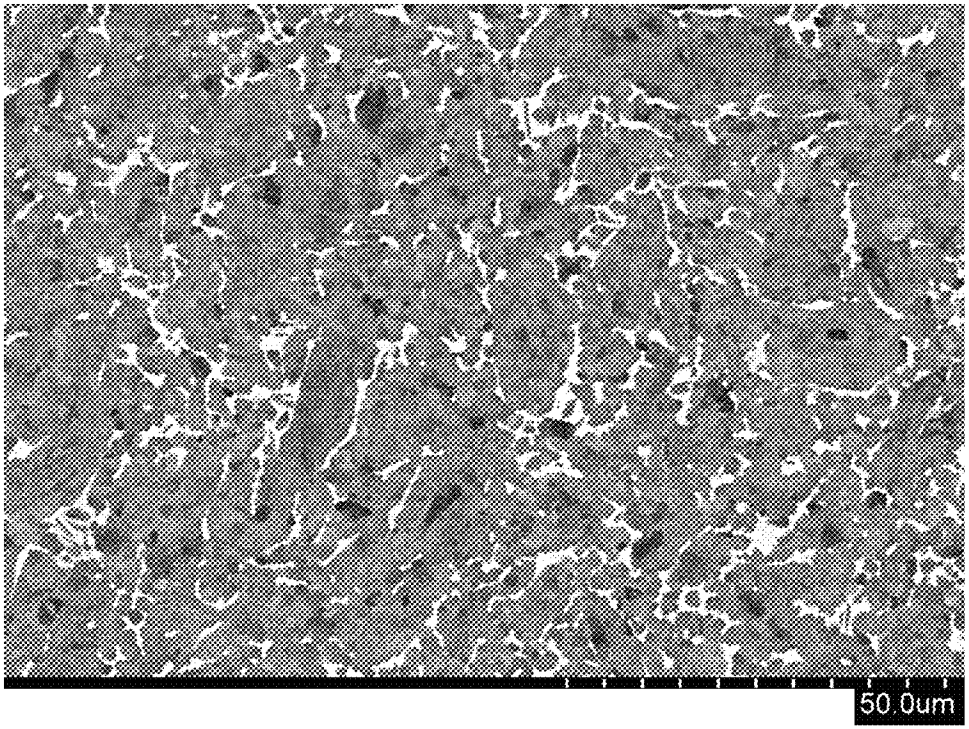
FIG. 15 is a BSE micrograph of the microstructure of a forged and slow cooled alpha-beta phase titanium alloy that was further forged according to a non-limiting embodiment of the method of the present disclosure.

FIG. 15 is a BSE micrograph of the resulting alloy. Again, grey shading levels are related to the average atomic number, thereby indicating chemical composition variations, and also variations locally with respect to crystal orientation. In the sample, light-colored regions are beta phase, and darker-colored regions are globular alpha-phase particles. Variation of the grey shading levels within globularized alpha-phase particles reveals crystal orientation changes, such as the presence of sub-grains and recrystallized grains.

Figure 16:
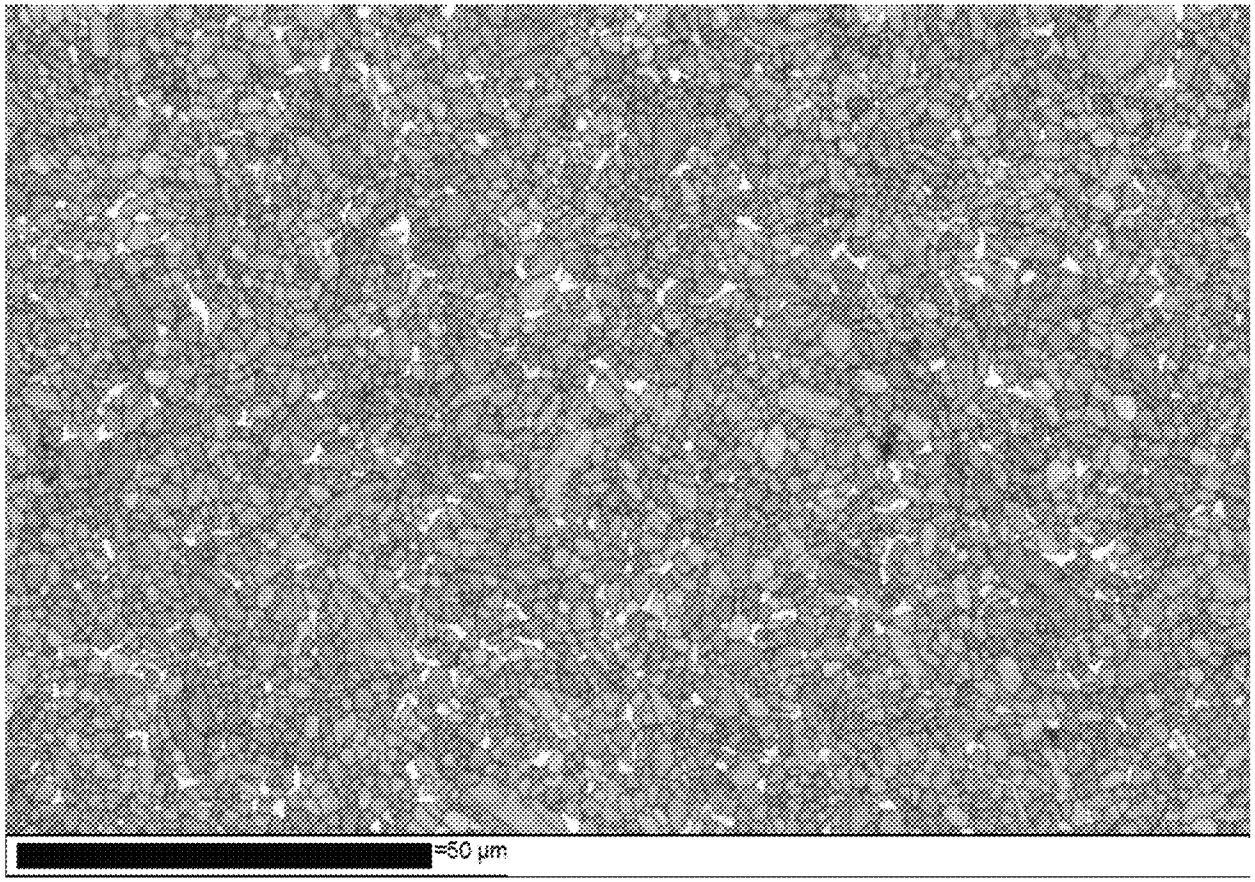
FIG. 16 is an EBSD micrograph of a forged and slow cooled alpha-beta phase titanium alloy that was further forged according to a non-limiting embodiment of the method of the present disclosure.

FIG. 16 is an EBSD micrograph of the sample of Example 4. The grey levels in this micrograph represent the quality of the EBSD diffraction patterns. It is seen in the micrograph of FIG. 16 that by forging the globularized sample of Example 1, the primary globularized alpha-phase particles recrystallize into finer alpha-phase grains within the original or primary globularized particles. The recrystallization transformation is almost complete as only few remaining unrecrystallized areas can be seen.

Figure 17A:
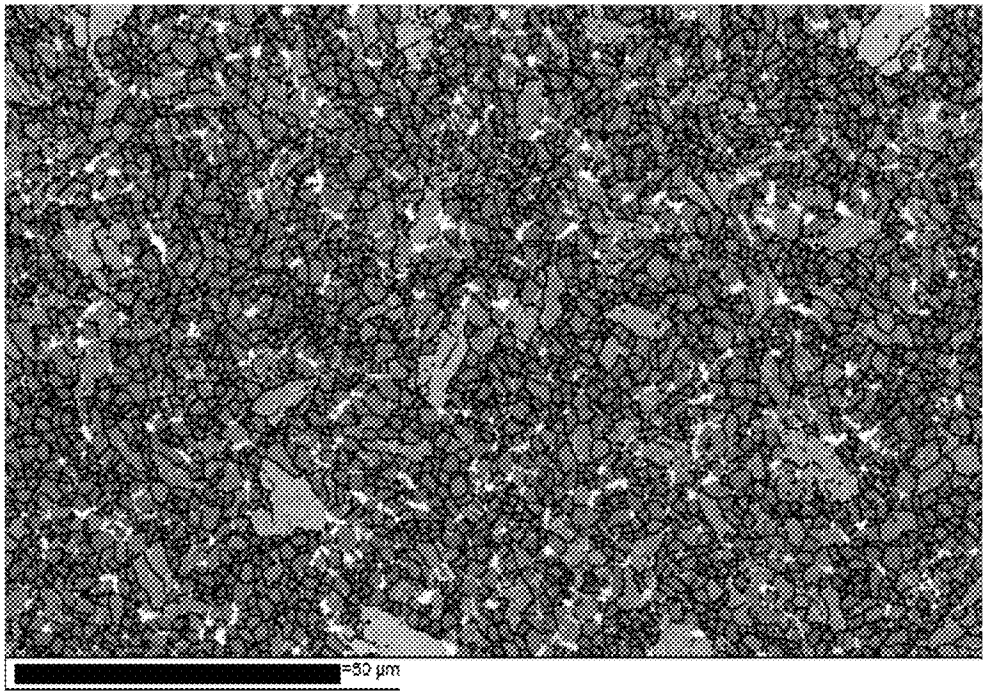
FIG. 17A is an EBSD micrograph of the sample of Example 4 that is a forged and slow cooled alpha-beta phase titanium alloy that was further forged according to a non-limiting embodiment of the method of the present disclosure.
Figure 17C:
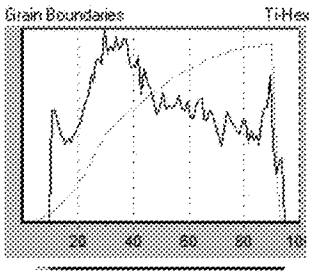
FIG. 17C is a plot of the distribution of disorientation of the alpha-phase grain boundaries of the sample of Example 4 shown in FIG. 17A.
Figure 17B:
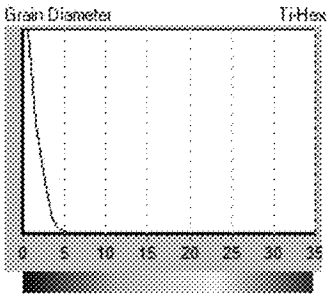
FIG. 17B is a plot showing the concentration of grains having a particular grain size in the sample of Example 4 shown in FIG. 17A.

FIG. 17A is an EBSD micrograph of the sample of Example 4. The grey shading levels in this micrograph represent grain sizes, and the grey shading levels of the grain boundaries are indicative of their disorientation. FIG. 17B is a plot showing the relative concentration of grains with particular grain sizes, and FIG. 17C is a plot of the distribution of disorientation of the alpha-phase grain boundaries. It may be determined from FIG. 17B that after forging the globularized sample of Example 1 and conducting the additional forging through 4 upsets and draws at temperature between 1450° F. and 1300° F., the alpha-phase grains are superfine (1 μm to 5 μm diameter).

Example 5

A full-scale billet of Ti-6-4 was quenched after some forging operations performed in the beta field. This workpiece was further forged through a total of 5 upsets and draws in the following approach: The first two upsets and draws were performed in the first temperature range to start the lamellae break down and globularization process, keeping its size in the range of about 22" to about 32" and a length or height range of about 40" to 75". It was then annealed at 1750° F. for 6 hours and furnace cooled down to 1400° F. at −100° F. per hour, with the aim of obtaining a microstructure similar to that of the sample of Example 1. It was then forged through 2 upsets and draws with reheats between 1400° F. and 1350° F., keeping its size in range of about 22" to about 32" with a length or height of about 40" to 75". Then another upset and draws was performed with reheats between 1300° F. and 1400° F., in a size range of about 20" to about 30" and a length or height range of about 40" to 70". Subsequent draws down to about 14" diameter were performed with reheats between 1300° F. and 1400° F. This included some V-die forging steps. Finally the piece was radially forged in a temperature range of 1300° F. to 1400° F. down to about 10" diameter. Throughout this process, intermediate conditioning and end-cutting steps were inserted to prevent crack propagation.

Figure 18:
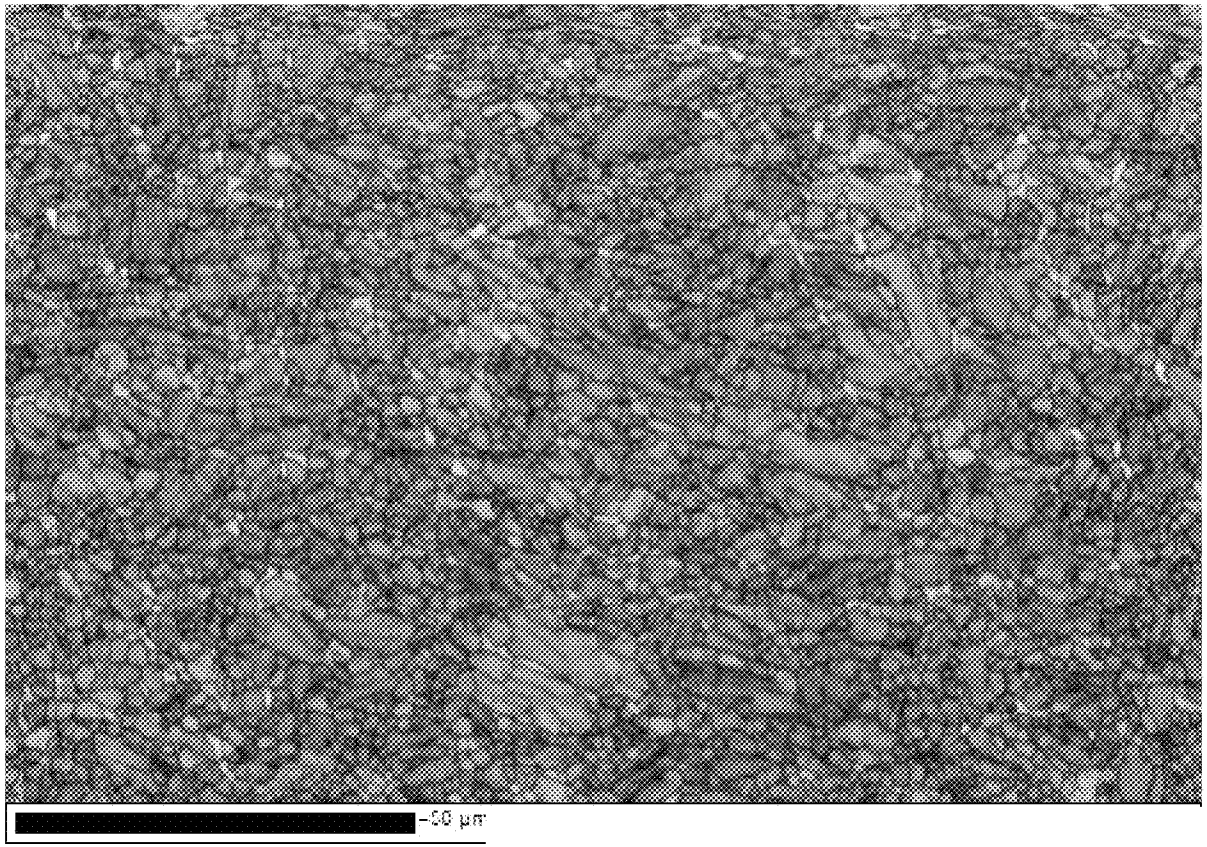
FIG. 18 is an EBSD micrograph of a forged and slow cooled alpha-beta phase titanium alloy that was further forged according to a non-limiting embodiment of the method of the present disclosure.

FIG. 18 is an EBSD micrograph of the resulting sample. The grey shading levels in this micrograph represent the quality of the EBSD diffraction patterns. It is seen in the micrograph of FIG. 18 that by forging first in the high alpha-beta field, slow cool, and then in the low alpha-beta field, the primary globularized alpha-phase particles begin to recrystallize into finer alpha-phase grains within the original or primary globularized particles. It is noted that only three upsets and draws were performed in the low alpha-beta field as opposed to Example 3 where four such upsets and draws had been carried out in that temperature range. In the present case, this resulted in lower recrystallization fraction. An additional sequence of upset and draws would have brought the microstructure to be very similar to that of Example 3. Also, an intermediate anneal during the low alpha-beta series of upsets and draws (box 118 of FIG. 1) would have improved the recrystallized fraction.

Figure 19A:
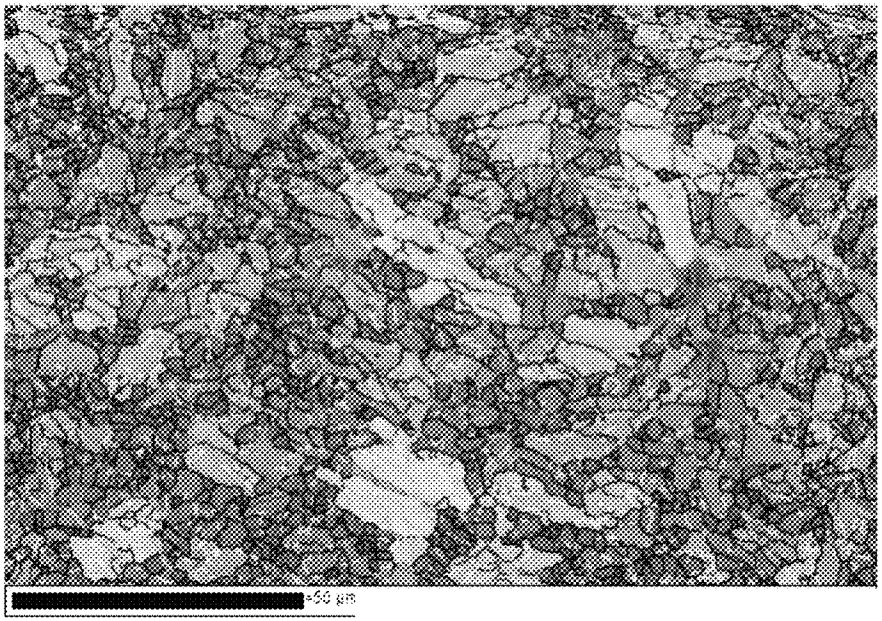
FIG. 19A is an EBSD micrograph of the sample of Example 4 that is a forged and slow cooled alpha-beta phase titanium alloy that was further forged according to a non-limiting embodiment of the method of the present disclosure.
Figure 19C:
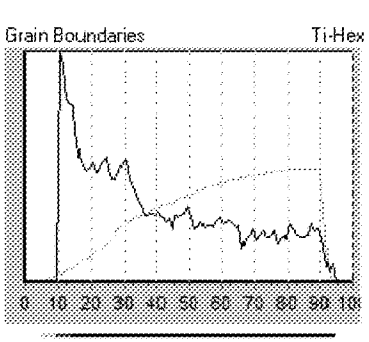
FIG. 19C is a plot of the distribution of disorientation of the alpha-phase grain boundaries of the sample of Example 4 shown in FIG. 19A.
Figure 19B:
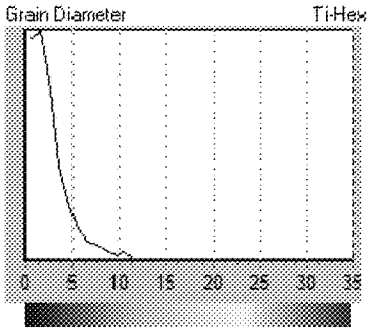
FIG. 19B is a plot showing the concentration of grains having a particular grain size in the sample of Example 4 shown in FIG. 19A.

FIG. 19A is an EBSD micrograph of the sample of Example 5. The grey shading levels in this micrograph represent grain sizes, and the grey shading levels of the grain boundaries are indicative of their disorientation. FIG. 19B is a plot of the relative concentration of grains with particular grain sizes, and FIG. 19C is a plot of the orientation of the alpha-phase grains. It may be determined from FIG. 19B that after forging the globularized sample of Example 1, with additional forging through 5 upsets and draws and an anneal performed at 1750° F. to 1300° F., the alpha-phase grains are considered to be fine (5 μm to 15 μm) to superfine (1 μm to 5 μm diameter).

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. A method of refining alpha-phase grain size in an alpha-beta titanium alloy, the method comprising:

working an alpha-beta titanium alloy at a first working temperature within a first temperature range, wherein the first temperature range is from a temperature 300° F. below a beta transus temperature of the alpha-beta titanium alloy to a temperature 30° F. below the beta transus temperature;

slow cooling the alpha-beta titanium alloy from the first working temperature, wherein on completion of working at the first working temperature and the slow cooling from the first working temperature, the alpha-beta titanium alloy comprises a primary globularized alpha-phase particle microstructure;

wherein the slow cooling occurs prior to any further working of the alpha-beta titanium alloy and comprises cooling the workpiece at a cooling rate no greater than 5° F. per minute;

working the alpha-beta titanium alloy at a second working temperature within a second temperature range, wherein the second temperature range is from a temperature 600° F. below the beta transus temperature to a temperature 350° F. below the beta transus temperature; and working the alpha-beta titanium alloy at a third working temperature in a third temperature range, wherein the third working temperature is lower than the second working temperature, wherein the third temperature range is 1000° F. to 1400° F., and wherein after working at the third working temperature, the alpha-beta titanium alloy comprises a desired refined alpha-phase grain size.

2. The method according to claim 1, wherein the alpha-beta titanium alloy is selected from Ti-6Al-4V alloy (UNS R56400), Ti-6Al-4V ELI alloy (UNS R56401), a Ti-6Al-2Sn-4Zr-2Mo alloy (UNS R54620), a Ti-6Al-2Sn-4Zr-6Mo alloy (UNS R56260), and a Ti-4Al-2.5V-1.5Fe alloy (UNS 54250).

3. The method according to claim 1, wherein the alpha-beta titanium alloy is selected from Ti-6Al-4V alloy (UNS R56400) and Ti-6Al-4V ELI alloy (UNS R56401).

4. The method according to claim 1, wherein the alpha-beta titanium alloy is a Ti-4Al-2.5V-1.5Fe alloy (UNS 54250).

5. The method according to claim 1, wherein the slow cooling comprises furnace cooling.

6. The method according to claim 1, wherein the slow cooling comprises transferring the alpha-beta titanium alloy from a furnace chamber at the first working temperature to a furnace chamber at the second working temperature.

7. The method according to claim 1, further comprising, before the slow cooling the alpha-beta titanium alloy from the first working temperature:

heat treating the alpha-beta titanium alloy at a heat treating temperature in a heat treating temperature range that is from a temperature 300° F. below a beta transus temperature of the alpha-beta titanium alloy up to a temperature 30° F. below the beta transus temperature of the alpha-beta titanium alloy; and holding the alpha-beta titanium alloy at the heat treating temperature.

8. The method according to claim 7, wherein holding the alpha-beta titanium alloy at the heat treating temperature comprises holding the alpha-beta titanium alloy at the heat treating temperature for 1 hour to 48 hours.

9. The method according to claim 1, further comprising, after working the alpha-beta titanium alloy at the second working temperature, annealing the alpha-beta titanium alloy.

10. The method according to claim 9, wherein annealing the alpha-beta titanium alloy comprises heating the alpha-beta titanium alloy at a temperature in an annealing temperature range of 500° F. below the beta transus temperature to 250° F. below the beta transus temperature for 30 minutes to 12 hours.

11. The method according to claim 1, wherein at least one of working the alpha-beta titanium alloy at the first temperature, working the alpha-beta titanium alloy at the second temperature, and working the alpha-beta titanium alloy at the third temperature comprises open die press forging.

12. The method according to claim 11, wherein each of the open die press forgings comprises upset forging.

13. The method according to claim 11, wherein each of the open die press forgings comprises draw forging.

14. The method according to claim 11, wherein each of the open die press forgings comprises at least one of upset forging and draw forging.

15. The method according to claim 11, wherein working the alpha-beta titanium alloy at the third working temperature comprises radial forging the alpha-beta titanium alloy.

16. The method according to claim 1, wherein at least one of working the alpha-beta titanium alloy at the first working temperature, working the alpha-beta titanium alloy at the second working temperature, and working the alpha-beta titanium alloy at the third working temperature comprises a plurality of open die press forgings, the method further comprising reheating the alpha-beta titanium alloy intermediate two successive press forgings.

17. The method according to claim 16, wherein reheating the alpha-beta titanium alloy comprises heating the alpha-beta titanium alloy to a previous working temperature and holding the alpha-beta titanium alloy at the previous working temperature for 30 minutes to 12 hours.

18. The method according to claim 1, further comprising:

beta heat treating the alpha-beta titanium alloy at a beta heat treating temperature prior to working the alpha-beta titanium alloy at the first working temperature;

wherein the beta heat treating temperature is within a temperature range from a beta transus temperature of the alpha-beta titanium alloy to a temperature 300° F. greater than the beta transus temperature of the alpha-beta titanium alloy; and quenching the alpha-beta titanium alloy.

19. The method according to claim 18, wherein beta heat treating the alpha-beta titanium alloy further comprises working the alpha-beta titanium alloy at the beta heat treating temperature.

20. The method according to claim 19, wherein working the alpha-beta titanium alloy at the beta heat treating temperature comprises one or more of roll forging, swaging, cogging, open-die forging, impression-die forging, press forging, automatic hot forging, radial forging, upset forging, draw forging, and multiaxis forging.

* * * * *